US012000314B1

(12) United States Patent
Tran

(10) Patent No.: US 12,000,314 B1
(45) Date of Patent: Jun. 4, 2024

(54) SYSTEM AND METHOD FOR VARIABLE VALVE TIMING

(71) Applicant: Jay Tran, Fountain Valley, CA (US)

(72) Inventor: Jay Tran, Fountain Valley, CA (US)

( * ) Notice: Subject to any disclaimer, the term of this patent is extended or adjusted under 35 U.S.C. 154(b) by 0 days.

(21) Appl. No.: 18/462,464

(22) Filed: Sep. 7, 2023

(51) Int. Cl.

| | |
|---|---|
| ***F01L 1/344*** | (2006.01) |
| ***F01L 1/46*** | (2006.01) |
| *F01L 1/02* | (2006.01) |
| *F01L 1/047* | (2006.01) |
| *F01L 13/00* | (2006.01) |

(52) U.S. Cl.
CPC ..... *F01L 1/34406* (2013.01); *F01L 1/3442* (2013.01); *F01L 1/46* (2013.01); *F01L 1/022* (2013.01); *F01L 1/047* (2013.01); *F01L 2001/34423* (2013.01); *F01L 2001/3443* (2013.01); *F01L 2001/34456* (2013.01); *F01L 2001/34473* (2013.01); *F01L 2001/34483* (2013.01); *F01L 2013/105* (2013.01)

(58) Field of Classification Search
CPC ..... F01L 1/022; F01L 1/047; F01L 1/34406; F01L 1/3442; F01L 2001/34423; F01L 2001/3443; F01L 2001/34456; F01L 2001/34483; F01L 1/46; F01L 2013/105
USPC ..... 123/90.17, 90.31
See application file for complete search history.

(56) References Cited

U.S. PATENT DOCUMENTS 5,469,818 A * 11/1995 Yoshioka ..... F02D 13/0234 123/90.31
5,483,930 A * 1/1996 Moriya ..... F01L 1/34406 123/90.31
5,628,286 A * 5/1997 Kato ..... F01L 1/34406 123/90.15
5,657,671 A * 8/1997 Morii ..... F01L 1/34406 474/900
5,669,343 A * 9/1997 Adachi ..... F01L 1/34406 123/90.31
5,694,912 A * 12/1997 Gotou ..... F01L 1/34406 123/674
6,026,772 A * 2/2000 Shirabe ..... F01L 1/3442 123/90.34
6,167,854 B1 1/2001 Daimlerchrysler
(Continued)

FOREIGN PATENT DOCUMENTS

JP H08189313 A * 7/1996

*Primary Examiner* — Jorge L Leon, Jr.
(74) *Attorney, Agent, or Firm* — SHIMOKAJI IP

(57) ABSTRACT

A variable valve timing assembly for a combustion engine comprises: a phaser configured to receive therein a camshaft; wherein the phaser includes a phaser exterior body that is cylindrical-shaped, a phaser interior body that is cylindrical-shaped and within the phaser exterior body, a phaser exterior spline on an exterior of the phaser exterior body, and a phaser interior spline on an exterior of the phaser interior body; a phaser inner housing disposed within the phaser and configured to receive therein the camshaft; wherein the phaser inner housing includes an inner housing interior spline that mates with the phaser interior spline; an advancing chamber configured to receive fluid from and discharge fluid to the camshaft; a retarding chamber configured to receive fluid from and discharge fluid to the camshaft; and a main housing that encloses therein the phaser and the phaser inner housing, and is configured to engage a timing chain/belt.

20 Claims, 15 Drawing Sheets

(56) References Cited

U.S. PATENT DOCUMENTS

| | | | | |
|---|---|---|---|---|
| 6,186,105 | B1 | 2/2001 | Yamaha | |
| 6,341,584 | B1 * | 1/2002 | Itoyama | F01L 1/34 903/918 |
| 7,322,327 | B1 | 1/2008 | Hyundai | |
| 9,797,280 | B2 | 10/2017 | Ford | |

* cited by examiner

SYSTEM AND METHOD FOR VARIABLE VALVE TIMING

BACKGROUND OF THE DISCLOSURE

The present invention generally relates to timing of valves in a combustion engine and, more particularly, to apparatus and methods of advancing/retarding the timing of intake and/or exhaust valves.

Valves are used to control the intake and exhaust of gases, such as in combustion engines. The valves move to allow such intake and exhaust in a timed fashion. The timing of such movement can affect engine performance.

Different engine conditions can be affected by valve timing. Thus, engine performance can be optimized or improved by varying the timing for opening and/or closing of the intake and/or exhaust valves. The timing, for example, may be advanced or retarded.

Varying the timing of valves has been attempted by various systems. One such system is an oil vane type variable timing apparatus. However, it has been difficult to fully seal the advance or retard chambers, which results in decreased effectiveness.

As can be seen, there is a need for improved apparatus and methods to vary valve timing.

SUMMARY OF THE DISCLOSURE

In one aspect of the present disclosure, a variable valve timing (VVT) assembly for a combustion engine comprises: a phaser configured to receive therein a camshaft of the combustion engine; wherein the phaser includes a phaser exterior body that is cylindrical-shaped, a phaser interior body that is cylindrical-shaped and within the phaser exterior body, a phaser exterior spline on an exterior of the phaser exterior body, and a phaser interior spline on an exterior of the phaser interior body; a phaser inner housing disposed within the phaser and configured to receive therein the camshaft; wherein the phaser inner housing includes an inner housing interior spline that mates with the phaser interior spline; an advancing chamber configured to receive fluid from and discharge fluid to the camshaft; a retarding chamber configured to receive fluid from and discharge fluid to the camshaft; and a main housing that encloses therein the phaser and the phaser inner housing, and is configured to engage a timing chain/belt of the combustion engine.

In another aspect of the present disclosure, a variable valve timing (VVT) assembly for a combustion engine comprises: a phaser configured to be actuated by a retarding spring; wherein the phaser includes a phaser exterior body, a phaser interior body within the phaser exterior body, a phaser gap circumferentially between the phaser exterior body and the phaser interior body, a phaser exterior spline, and a phaser interior spline; a phaser inner housing that is cylindrical-shaped, disposed in the phaser gap, and configured to receive therein the camshaft; wherein the phaser inner housing includes an inner housing body that is cylindrical-shaped and an inner housing interior spline on an interior of the inner housing body that mates with the phaser interior spline; an advancing chamber having a variable volume that is related to a linear position of the phaser; a retarding chamber having another variable volume that is related to the linear position of the phaser; and a main housing that mates with the phaser.

In a further aspect of the present disclosure, a variable valve timing (VVT) assembly for a combustion engine comprises: a phaser that includes a phaser exterior helical spline and a phaser interior straight spline; a phaser inner housing within the phaser and includes an inner housing interior straight spline that mates with the phaser interior straight spline; a ring-shaped advancing chamber interiorly of the phaser inner housing, and is configured to be in fluid communication with a fluid pumping assembly; a ring-shaped retarding chamber interiorly of the phaser interior straight spline and is configured to be in fluid communication with the advancing chamber; and a main housing that includes interior helical teeth that mate with the phaser exterior helical spine, and the main housing operationally engages therein a camshaft of the combustion engine; wherein the advancing chamber has an advancing variable fluid volume; wherein, when the advancing variable fluid volume is increased, the phaser moves in one linear direction; wherein the retarding chamber has a retarding variable fluid volume; wherein, when the retarding variable fluid volume is increased, the phaser moves in an opposite linear direction.

In yet another aspect of the present disclosure, a computer implemented method of varying a valve timing in a combustion engine comprises controlling, by a controller, a fluid flow into and out of a ring-shaped advancing chamber of the combustion engine; wherein the advancing chamber is configured to cause rotation of a camshaft of the combustion engine in one direction; controlling, by the controller, a fluid flow into and out of a ring-shaped retarding chamber of the combustion engine; wherein the retarding chamber is configured to cause rotation of the camshaft in an opposite direction; and controlling, by the controller, rotation of the camshaft to a maximum advance mode, to a maximum retard mode, and to a continuum of modes therebetween.

In a still further aspect of the present disclosure, a non-transitory computer readable medium with executable instructions stored thereon, executed by a processor, to perform a method for varying a valve timing in a combustion engine, wherein the method comprises varying a size of a ring-shaped advancing chamber of the combustion engine; varying a size of a ring-shaped retarding chamber of the combustion engine inversely to the size of the advancing chamber; changing a linear position of a phaser of the combustion engine based on at least one of the size of the advancing chamber and the size of the retarding chamber, wherein the phaser is operatively engaged to a camshaft of the combustion engine; and changing a rotational position of the camshaft based on the linear position of the phaser.

These and other features, aspects and advantages of the present disclosure will become better understood with reference to the following drawings, description, and claims.

DESCRIPTION OF THE DISCLOSURE

Figure 1:
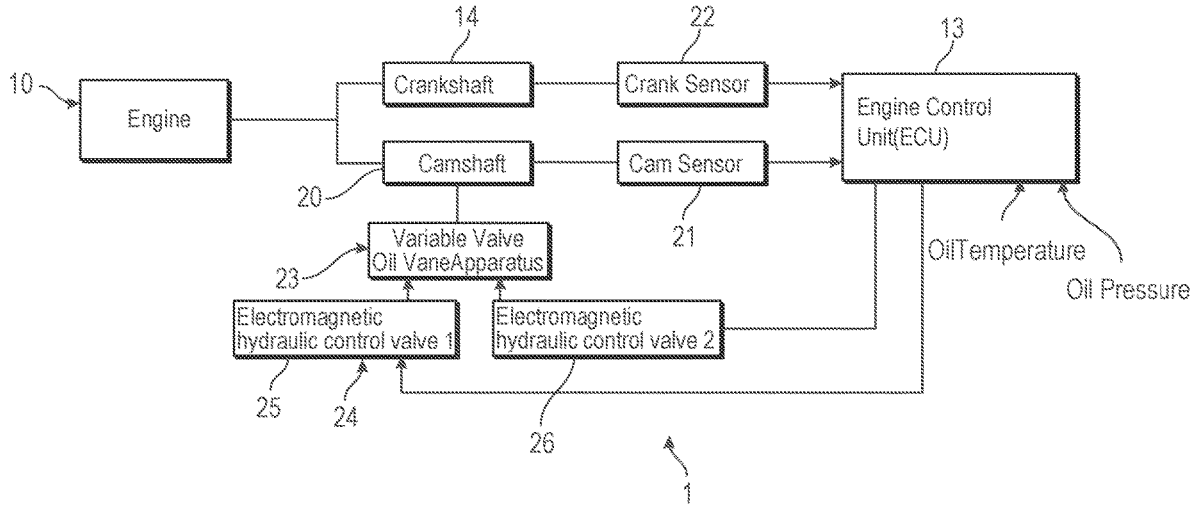
FIG. 1 is a schematic view of an exemplary embodiment of a system according to the present disclosure.

The following detailed description is of the best currently contemplated modes of carrying out the disclosure. The description is not to be taken in a limiting sense, but it is made merely for the purpose of illustrating the general principles of the disclosure, since the scope of the disclosure is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

The technical problems to be solved are sealing components in a variable valve timing (VVT) assembly of a combustion engine while enabling the VVT assembly to operate at and a continuum between maximum advance and maximum retard modes.

Broadly, the present disclosure solves the foregoing problems by a VVT assembly having a main housing, a phaser within the main housing, a phaser inner housing within the phaser, a ring-shaped advancing chamber within the phaser inner housing, and a ring-shaped retarding chamber within the phaser. A fluid volume size of both chambers can be inversely varied.

For example, according to the present disclosure, when the volume size of the advancing chamber is increased, the phaser moves linearly, along a camshaft, in one direction. When the volume size of the retarding chamber is increased, the phaser moves linearly, along the camshaft, in an opposite direction. The phaser inner housing remains in a fixed linear position relative to the camshaft, irrespective of the linear movement of the phaser. The linear movement (i.e., advancing or retarding) of the phaser is converted to rotational movement (i.e., advancing or retarding) of the phaser inner housing which is fixedly engaged, rotationally and longitudinally, to the camshaft. Rotational movement of the phaser inner housing is transferred to rotation of the camshaft to advance or retard the camshaft. Thus, the camshaft may be advanced or retarded along a continuum between a maximum advance position and a maximum retard position.

As will be appreciated by one skilled in the art, aspects of the present disclosure may be embodied as a system, method, or computer program product. Accordingly, aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present disclosure may take the form of a computer program product embodied in one or more computer readable media having computer readable program code embodied thereon.

Any combination of one or more computer readable storage media may be utilized. A computer readable storage medium is an electronic, magnetic, optical, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium is any tangible medium that can store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described below with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable storage medium that can direct a computer, other programmable data processing apparatus, or other devices to function in a particular manner, such that the instructions stored in the computer readable storage medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

FIG. 1, according to an exemplary embodiment of the present disclosure, is a schematic view of a system 1, such as a vehicle, that can include a combustion engine 10. The engine 10 may have a crankshaft 14 and a camshaft 20. A crank sensor 22 and a cam sensor 21 may be in respective communication with the crankshaft 14 and the camshaft 20. The engine 10 may also have a variable valve oil valve apparatus or variable valve timing (VVT) assembly 23 that can vary timing of the camshaft 20.

According to an exemplary embodiment, system 1 may further have a computer/processor/memory/controller or engine control unit (ECU) 13. In exemplary embodiments, system 1 may also include a fluid pumping assembly 24 that may be configured to pump fluid, such as engine oil, to the VVT assembly 23. The fluid pumping assembly 24 may have an electromagnetic hydraulic control valve 1 (first control valve) 25 and an electromagnetic hydraulic control valve 2 (second control valve) 26.

Figure 2:
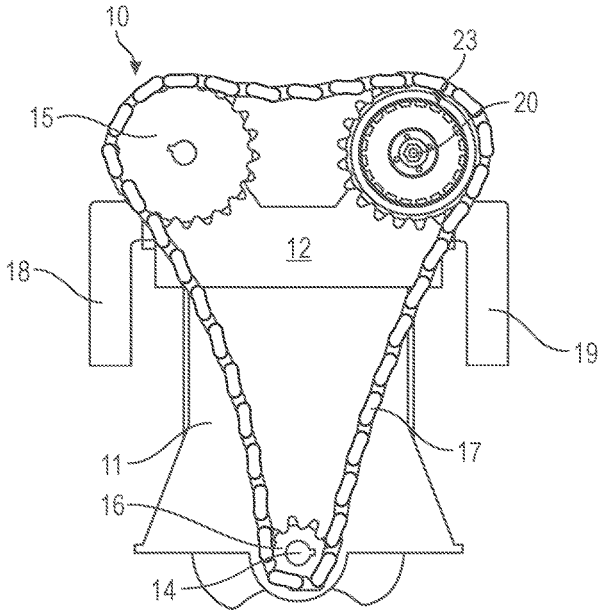
FIG. 2 is a front elevation view of an exemplary embodiment of an engine according to the present disclosure.
Figure 3:
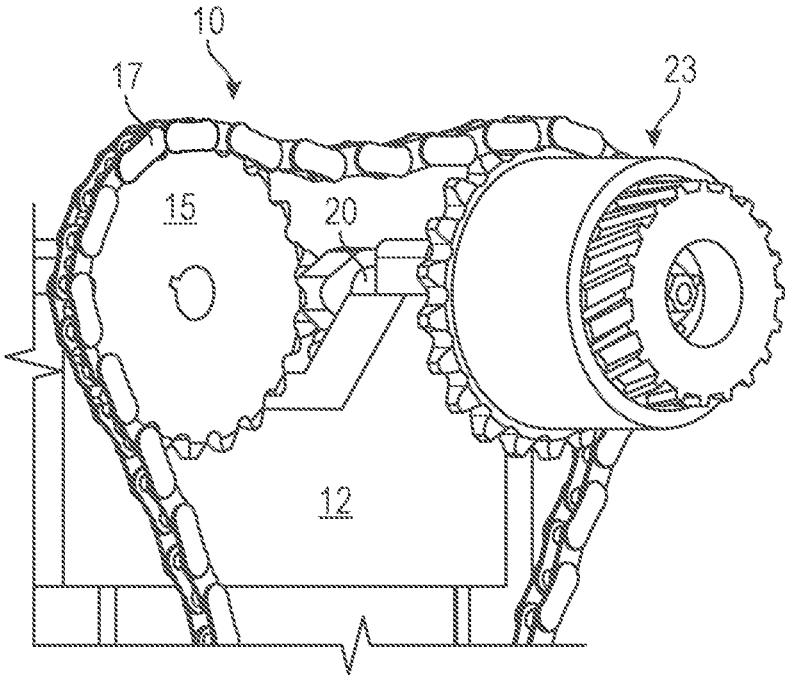
FIG. 3 is a partial perspective view of an exemplary embodiment of an engine according to the present disclosure.

FIGS. 2 and 3 depict portions of engine 10 according to an exemplary embodiment of the present disclosure. In an exemplary embodiment, engine 10 may include a cylinder block 11 and a cylinder head 12. The engine 10 may have an intake manifold 18 and an exhaust manifold 19 in communication with the cylinder head 12. The engine 10 may include the crankshaft 14 that is engaged to a crankshaft sprocket 16. The crankshaft sprocket 16 may be engaged to a timing chain/belt 17. In turn, the timing chain/belt 17 may be engaged to one or more valve sprocket(s) 15 which, in turn, may be engaged to an intake or exhaust camshaft (not shown). The timing chain/belt 17 may also be engaged to one or more VVT assemblies 23 which, in turn, may be engaged to an intake or exhaust camshaft 20.

Figure 4:
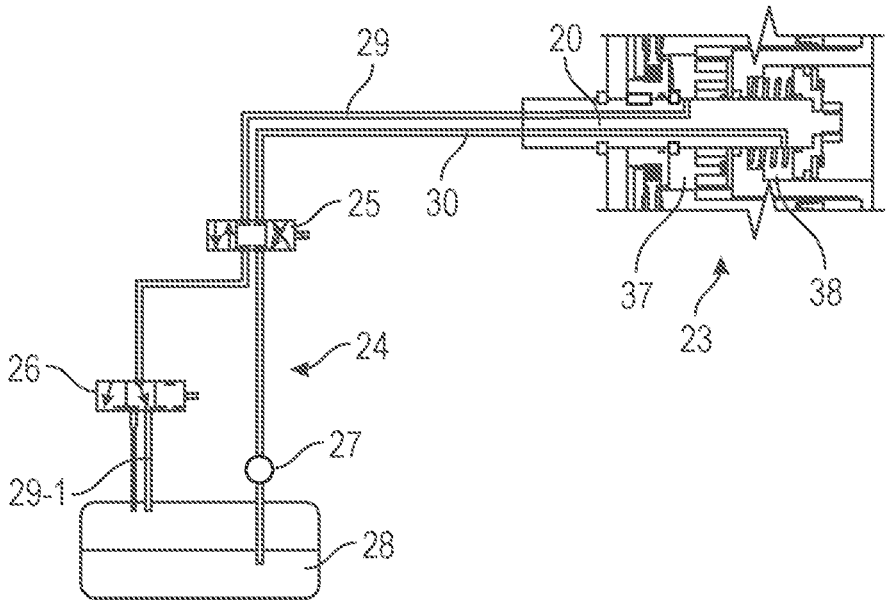
FIG. 4 is a schematic view of an exemplary embodiment of a fluid pumping assembly and a cross-sectional of an exemplary embodiment of a variable valve timing assembly according to the present disclosure.

FIG. 4 depicts an exemplary interface/engagement between a VVT assembly 23 (partially shown) and a fluid pumping assembly 24 (schematically shown) according to an exemplary embodiment of the present invention. In an exemplary embodiment, the VVT assembly 23 may include an advancing chamber 37 and a retarding chamber 38. Either or both chambers 37, 38 may be in fluid communication, via the camshaft 20, with the fluid pumping assembly 24.

In an exemplary embodiment, the fluid pumping assembly 24 may be disposed inside or outside of the cylinder head 12. The fluid in the fluid pumping assembly 24 may be engine oil, such as from the cylinder head 12. In an exemplary embodiment, the fluid pumping assembly 24 may include a first or advancing fluid line 29. The advancing fluid line 29 may extend from the advancing chamber 37, through the camshaft 20, and to the first control valve 25. Similarly, the fluid pumping assembly 24 may include a second or retarding fluid line 30. The retarding fluid line 30 may extend from the retarding chamber 38, through the camshaft 20, and to the first control valve 25, in an exemplary embodiment.

The fluid pumping assembly 24, according to an exemplary embodiment, may include the second control valve 26 that can operate in line with the first control valve 25 and the advancing fluid line 29. A pump 27 may operate in line with the first control valve 25 and the retarding fluid line 30, in an embodiment. A fluid reservoir 28 may operate in parallel with the pump 27 and the second control valve 26. In an exemplary embodiment, the first and/or second control valve 25, 26 is a three-way valve. A third or additional fluid line 29-1 can extend parallel to and between the second control valve 26 and the fluid reservoir 28.

According to exemplary embodiments, the fluid pumping assembly 24 can operate in multiple modes—a maximum advance mode, a maximum retard mode, and a continuum of modes therebetween which can include a neutral mode wherein the camshaft 20 is neither advanced nor retarded. In the maximum advance mode, according to an exemplary embodiment, the fluid pumping assembly 24 can cause the VVT assembly 23 to operate in a maximum advance mode, whereby a phase angle of the camshaft 20 is adjusted to a maximum advance mode or position. Similarly, in the maximum retard mode, according to an exemplary embodiment, the fluid pumping assembly 24 can cause the VVT assembly 23 to operate in a maximum retard mode, whereby a phase angle of the camshaft 20 is adjusted to a maximum retard mode or position.

FIGS. 5 through 9 depict a VVT assembly 23 according to an exemplary embodiment of the present disclosure. The VVT assembly 23 may include a main housing 31, a phaser 32, and a phaser inner housing 33. The main housing 31, according to an exemplary embodiment, may enclose the phaser 32 and the phaser inner housing 33, while the phaser 32 may enclose the phaser inner housing 33. In exemplary embodiments, the VVT assembly 23 and each of the foregoing components can be configured to operate in multiple modes—a maximum advance mode, a maximum retard mode, and a continuum of modes therebetween which can include a neutral mode wherein the camshaft 20 is neither advanced nor retarded. The continuum of modes is not limited to pre-set stepped changes in amounts of rotation, according to exemplary embodiments. Rather, the continuum of modes can be a single continuous range of changes in degrees of rotation, which can correlate to how little the main housing 31, the phaser 32, and/or the phaser inner housing 33 can rotate at any given time, according to exemplary embodiments.

Figure 5:
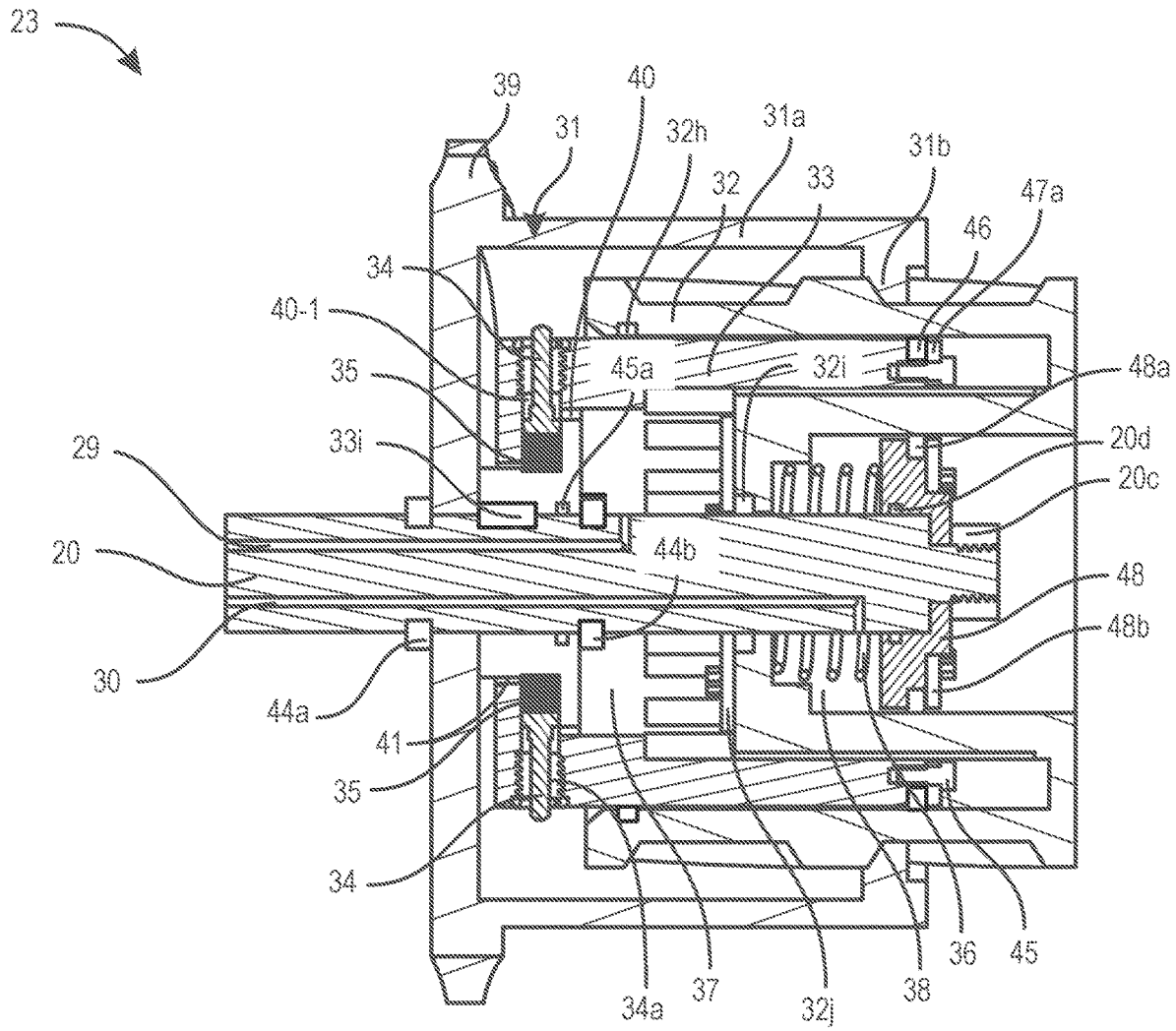
FIG. 5 is a cross-sectional view of an exemplary embodiment of a variable valve timing assembly according to the present disclosure.
Figure 6:
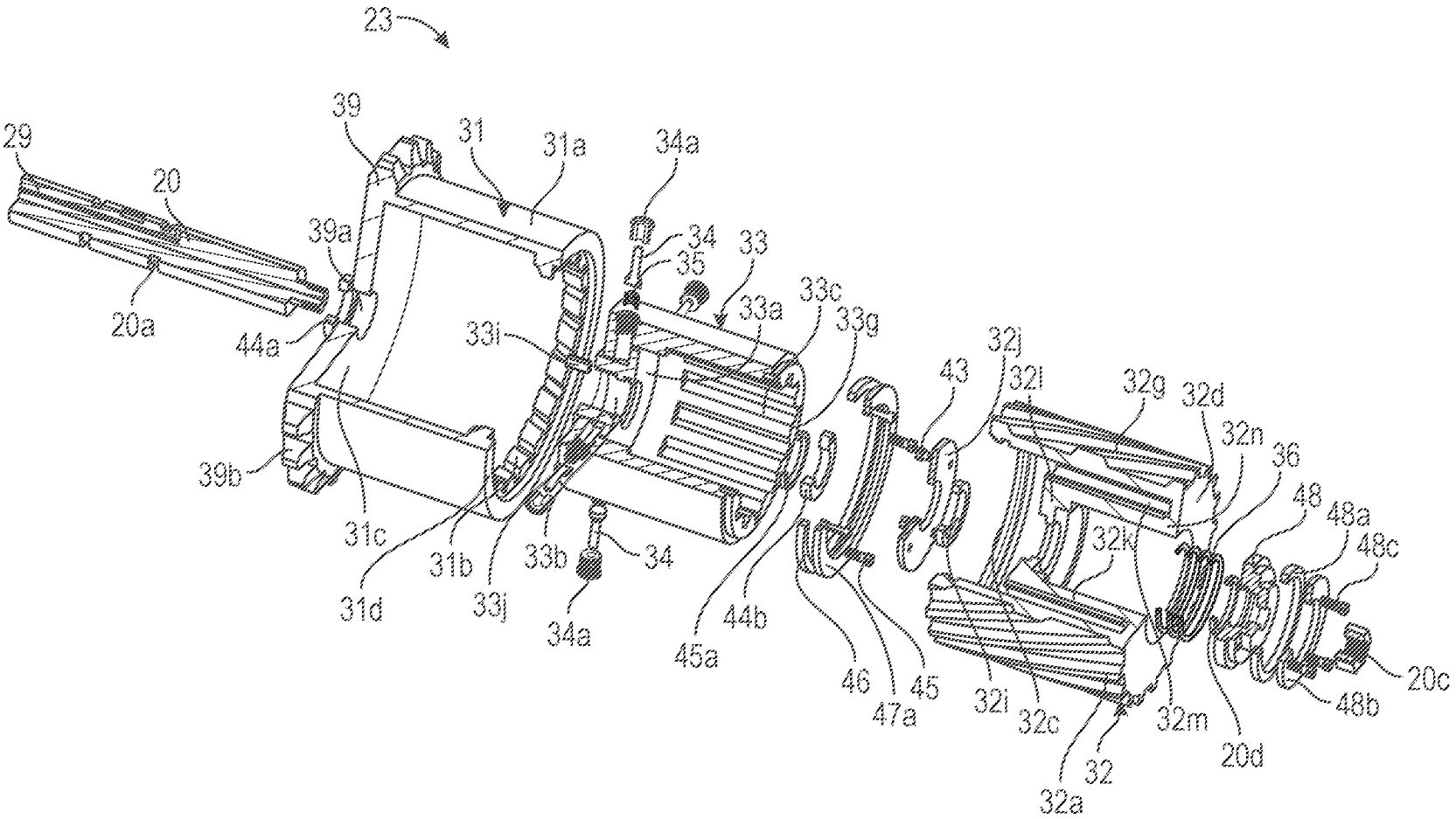
FIG. 6 is a perspective, exploded view of an exemplary embodiment of a variable valve timing assembly according to the present disclosure.
Figure 7:
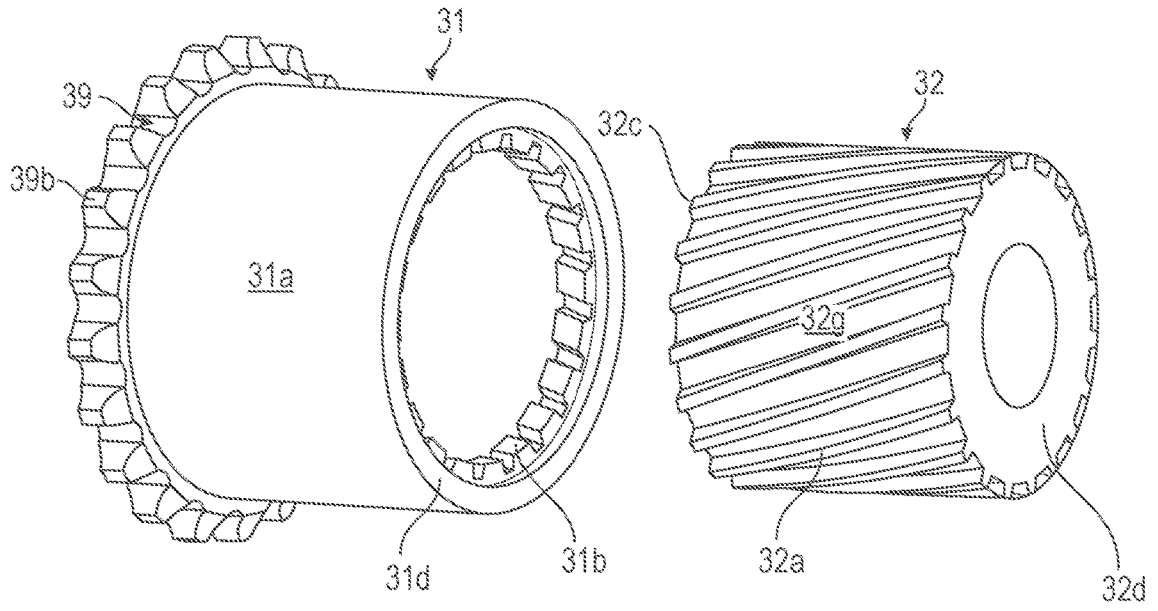
FIG. 7 is a perspective, exploded view of an exemplary embodiment of a portion of a variable valve timing assembly according to the present disclosure.

In FIGS. 5, 6, and 7, according to an exemplary embodiment, the main housing 31 can be configured to mate with the phaser 32. The main housing 31 may be further configured to receive therethrough and operationally engage the camshaft 20. The main housing 31 can be configured to cause rotation of the camshaft 20 in opposite directions. The main housing 31 can also be configured to engage the timing chain/belt 17. According to an exemplary embodiment, the main housing 31 can be configured to rotate as a main housing sprocket 39 described below is driven by the timing chain/belt 17. The main housing 31 may be configured to operatively move the phaser 32 in a linear direction upon rotation of the main housing 31.

In an exemplary embodiment, the main housing 31 may have an overall cylindrical shape. The main housing 31 may include a main housing body 31*a* which can be cylindrical-shaped, according to an exemplary embodiment. The main housing 31 may further include a main housing partially closed end 31*c* and a main housing open end 31*d*. In an exemplary embodiment, the partially closed end 31*c* and the open end 31*d* can be configured to receive the camshaft therethrough.

In an exemplary embodiment, a main housing teeth/spline 31*b* may be configured to mate with a phaser exterior spline 32*a* described below. The main housing teeth/spline 31*b* may be disposed at the main housing open end 31*d* and on an interior surface of the main housing body 31*a*. In an exemplary embodiment, the main housing teeth 31*b* may extend about an entire circumference of the main housing open end 31*d*. In an exemplary embodiment, the main housing teeth 31*b* can have a helical configuration.

In an exemplary embodiment, the main housing 31 may have a main housing sprocket 39 configured to engage the timing chain/belt 17. The main housing sprocket 39 may be at the main housing partially closed end 31*c*. The main housing sprocket 39 may include a main housing sprocket aperture 39*a* configured to receive therethrough the camshaft 20, in an exemplary embodiment. The main housing sprocket 39 may also include main housing sprocket teeth 39*b*. In an exemplary embodiment, the main housing sprocket teeth 39*b* may extend about the entire circumference of the sprocket 39 and may be configured to engage the timing chain/belt 17. In an exemplary embodiment, the main housing sprocket teeth 39*b* may have a straight configuration.

In FIGS. 5, 6, 7 and 8, according to an exemplary embodiment, the phaser 32 can be configured to receive therethrough the camshaft 20. In an exemplary embodiment, the phaser 32 can be configured to fix and unfix a position relative to the phaser inner housing 33. The phaser 32 can also be configured to operationally engage the timing chain/belt 17. Further, the phaser 32 may be configured to be actuated by a retarding spring 36 described below.

According to an exemplary embodiment, the phaser 32 can be configured to rotate as the main housing sprocket 39 is driven by the timing chain/belt 17. The phaser 32 can be configured to convert linear movement of the phaser 32 to rotational movement of the main housing 31. The phaser 32 can be further configured to rotate with the rotation of the main housing 31 and the camshaft 20, in an exemplary embodiment. The phaser 32 can also be configured to move in two opposite linear directions along a longitudinal axis of the camshaft 20 and thereby cause the camshaft 20 to rotate in two opposite rotational directions.

In an exemplary embodiment, phaser 32 may have an overall cylindrical shape and be disposed inside the main housing 31. The phaser 32 may have a phaser exterior body 32*g* and, disposed therein, a phaser interior body 32*k*, according to an exemplary embodiment. The phaser exterior body 32*g* and the phaser interior body 32*k* can be cylindrical-shaped, and the two bodies can be separated from each other circumferentially by a phaser gap 32*m*, which gap can also be cylindrical-shaped, according to an exemplary embodiment.

The phaser 32 may further include, on the phaser exterior body 32*g*, a phaser exterior open end 32*c* and a phaser exterior partially closed end 32*d*. The phaser 32 may further include, on the phaser interior body 32*k*, a phaser interior partially closed end 321, and a phaser interior open end 32*n*. In an exemplary embodiment, the phaser ends 321, 32*n*, the phaser exterior open end 32*c*, and the phaser exterior partially closed end 32*d* can be configured to enable the camshaft 20 to extend therethrough.

In an exemplary embodiment, the phaser 32 can include a phaser exterior spline 32*a* on an entire exterior surface of the phaser exterior body 32*g*. In an exemplary embodiment, the phaser exterior spline 32*a* may be configured to mate with the main housing teeth/spline 31*b*. In an exemplary embodiment, the phaser exterior spline 32*a* may be helical in configuration.

According to an exemplary embodiment, the phaser 32 can include a phaser interior spline 32*e* on an entire exterior surface of the phaser interior body 32*k*. In an exemplary embodiment, the phaser interior spline 32*e* may be configured to mate with an inner housing interior spline 33*c* described below. In an exemplary embodiment, the phaser interior spline 32*e* may be straight in configuration. The phaser interior spline 32*e* may have phaser fluid channels 32*f* extending on the ridges of the phaser interior spline 32*e*, in an exemplary embodiment.

Figure 8:
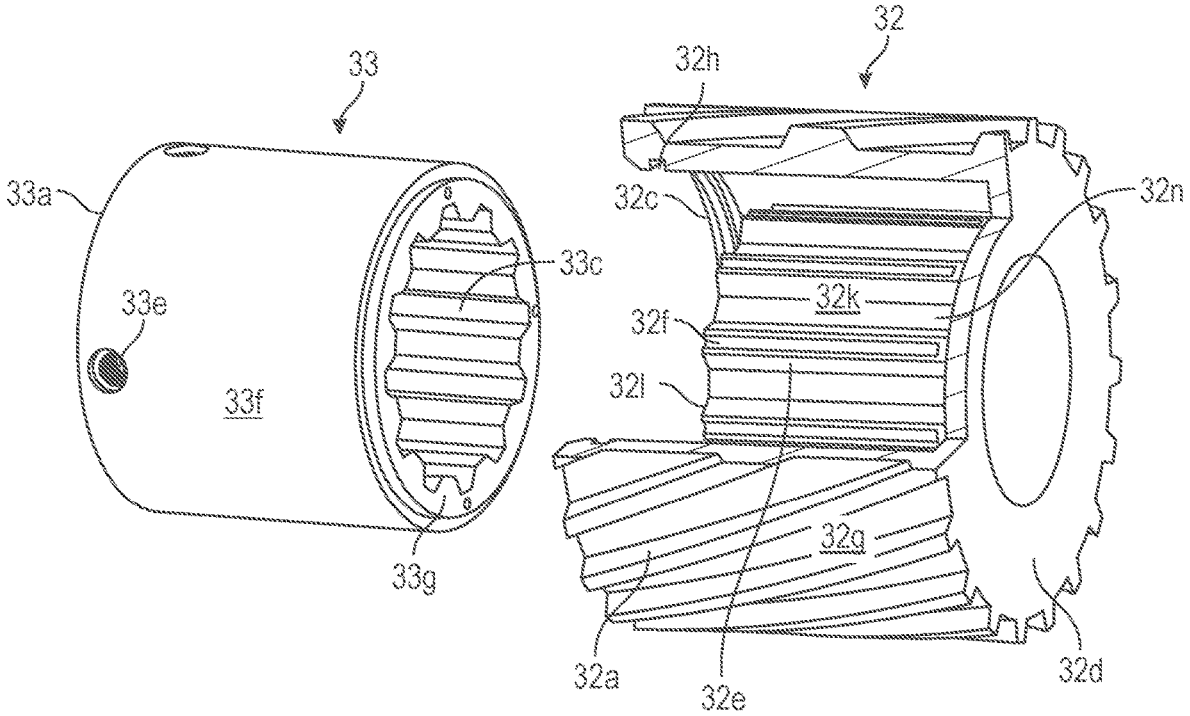
FIG. 8 is a perspective, exploded view of an exemplary embodiment of another portion of a variable valve timing assembly according to the present disclosure.

In FIGS. 5, 6, and 8, according to an exemplary embodiment, the phaser inner housing 33 can be configured to receive therethrough the camshaft 20. The phaser inner housing 33 can be configured to rotate the camshaft 20 upon rotation of the phaser inner housing 33.

The phaser inner housing 33 can also be configured to operationally engage the timing chain/belt 17. According to an exemplary embodiment, the phaser inner housing 33 can be configured to rotate as the main housing sprocket 39 is driven by the timing chain/belt 17. The phaser inner housing 33 can be further configured to rotate with the rotation of the main housing 31, the phaser 32, and the camshaft 20, in an exemplary embodiment.

In an exemplary embodiment, phaser inner housing 33 may have an overall cylindrical shape and be disposed inside the phaser 32. The phaser inner housing 33 may have an inner housing body 33*f* which, according to an exemplary embodiment, can be cylindrical-shaped, and can be disposed within the phaser gap 32*m*.

The phaser inner housing 33, in an exemplary embodiment, may include the inner housing interior spline 33*c* on less than an entire interior surface of the inner housing body 33*f*. In an exemplary embodiment, the inner housing interior spline 33*c* may be configured to mate with the phaser interior spline 32*e*. The inner housing interior spline 33*c* may have a straight configuration. Accordingly, in an exemplary embodiment, as the phaser 32 moves linearly, the phaser inner housing 33 may remain in a fixed linear position relative to the phaser 32.

Figure 9:
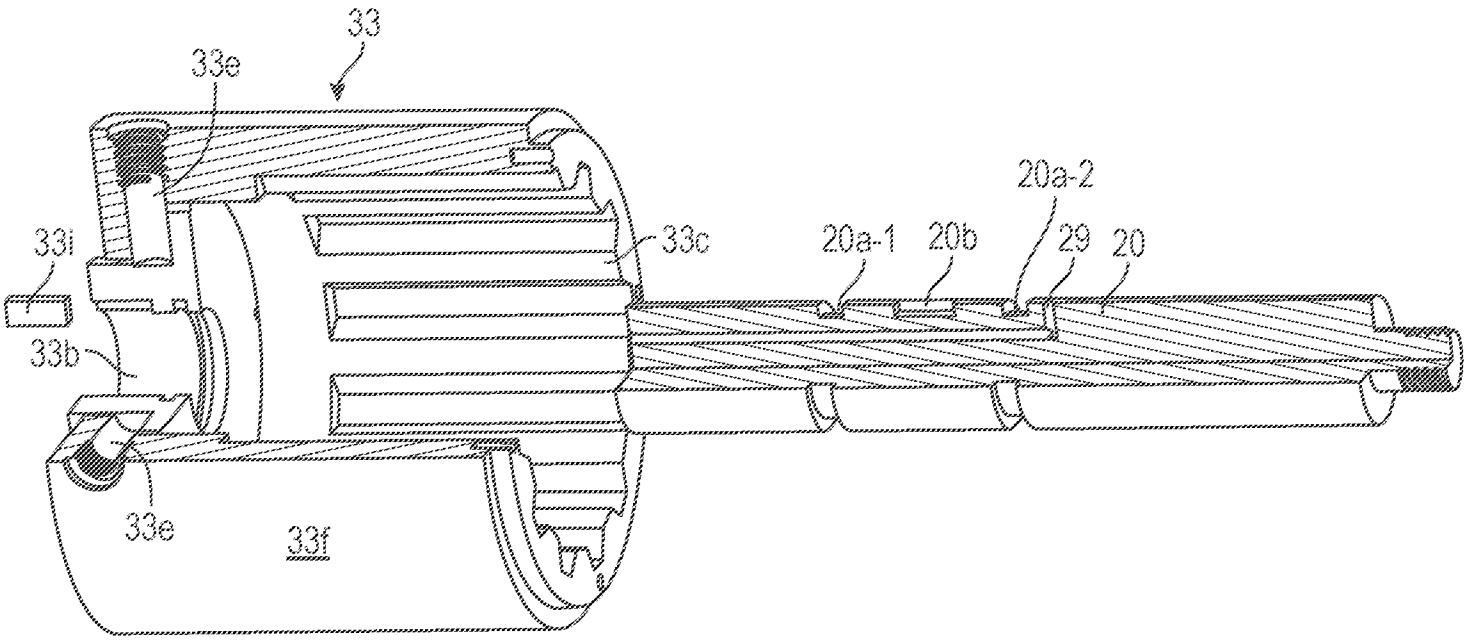
FIG. 9 is a perspective, exploded view of an exemplary embodiment of still another portion of a variable valve timing assembly according to the present disclosure.

The phaser inner housing 33 may further include an inner housing partially closed end 33*a* and an inner housing open end 33*g*, in an exemplary embodiment. An inner housing aperture 33*b* may be disposed in the inner housing partially closed end 33*a*. The inner housing aperture 33*b* may be configured to receive therein the camshaft 20. An inner housing notch 33*j* may be on an interior surface of the inner housing aperture 33*b*, in an exemplary embodiment. The inner housing notch 33*j* may be configured to receive therein an inner housing pin 33*i*. According to an exemplary embodiment, the inner housing pin 33*i* may be configured to fit in a camshaft slot 20*b* (FIG. 9). Thereby, a relative rotational position is fixed between the camshaft 20 and the phaser inner housing 33.

The phaser inner housing 33 may further include, in the inner housing body 33*f* and/or inner housing partially closed end 33*a*, one or more radially extending inner housing holes 33*e*, in an exemplary embodiment. One or more inner housing locking pins 34 may be in the one or more inner housing holes 33*e*. One or more locking pin nuts 34*a* may be screwed onto tops of the one or more inner housing locking pins 34, in an exemplary embodiment. One or more locking springs 35 may be disposed around the middle and/or lower portion of the one or more locking pins 34. Thereby, the one or more inner housing locking pins 34 may be inserted, at top portions thereof, into one or more phaser slots or grooves 32*h* (FIG. 8), in an exemplary embodiment. So inserted, a linear position of the phaser inner housing 33 and the phaser 33 may be fixed or locked relative to one another, such as when the VVT assembly 23 is in a maximum retard mode.

In FIGS. 5 and 6, according to an exemplary embodiment, the VVT assembly 23 may include a retarding spring 36 that can be configured to exert a spring force on the phaser 32. The retarding spring 36 may be configured to move the phaser 32 in a linear direction. The retarding spring 36 may also be configured to enable the phaser 32 to be fixed to the phaser inner housing 33, in an exemplary embodiment. The retarding spring 36 may further be configured to enable a change in volume size of the retarding chamber 38, in an exemplary embodiment.

The retarding spring 36 may be disposed within the phaser interior body 32*k* and against the phaser interior partially closed end 321. In an exemplary embodiment, the retarding spring 36 can be in an extended mode or configuration and provide a spring force against the phaser interior partially closed end 321. The retarding spring 36 may move the phaser 32 to the left in the drawings, when the VVT assembly 23 is in a maximum retard mode as described above. Likewise, in an exemplary embodiment, the retarding spring 36 can be in a compressed mode or configuration and be compressed by the phaser interior partially closed end 321. When compressed, the retarding spring may allow the phaser 32 to move to the right in the drawings, when the VVT assembly 23 is in a maximum retard mode as described above.

Figure 10:
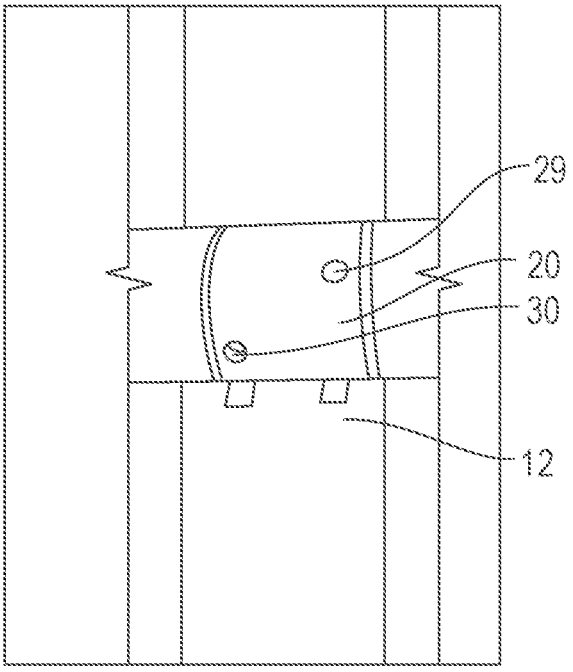
FIG. 10 is a perspective view of an exemplary embodiment of a portion of a fluid pumping assembly according to the present disclosure.

FIG. 10 depicts an exemplary embodiment of an interface between the camshaft 20 and the fluid pumping assembly 24, and more specifically the advancing fluid line 29 and the retarding fluid line 30. On an exterior surface of the camshaft 20, the fluid lines 29, 30 can be holes that can interface respective channels in the cylinder head 12. Thereby, as the camshaft 20 rotates, fluid, such as engine oil, can flow into and out of the camshaft 20 to either fill or drain the advancing chamber 37 and retarding chamber 38 described below. As can be appreciated by those skilled in the art, means for fluid communication between the camshaft 20 and the cylinder head 12 is well known and can be utilized herein.

Figure 11A:
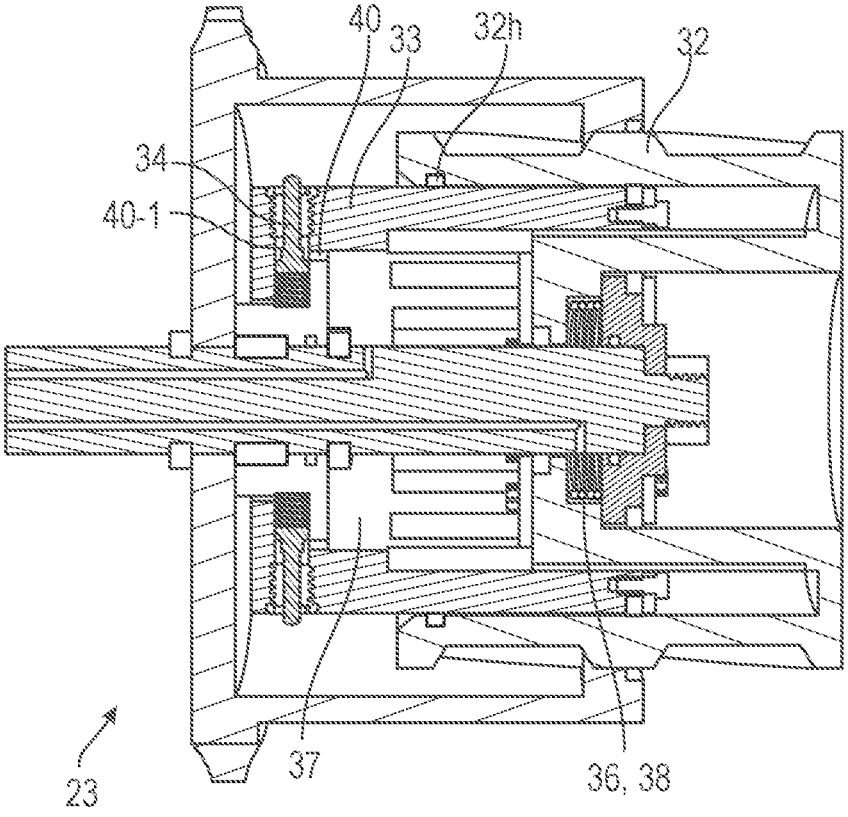
FIGS. 11A-11C are cross-sectional views of exemplary embodiments of a variable valve timing assembly in different stages of operation according to the present disclosure.
Figure 11B:
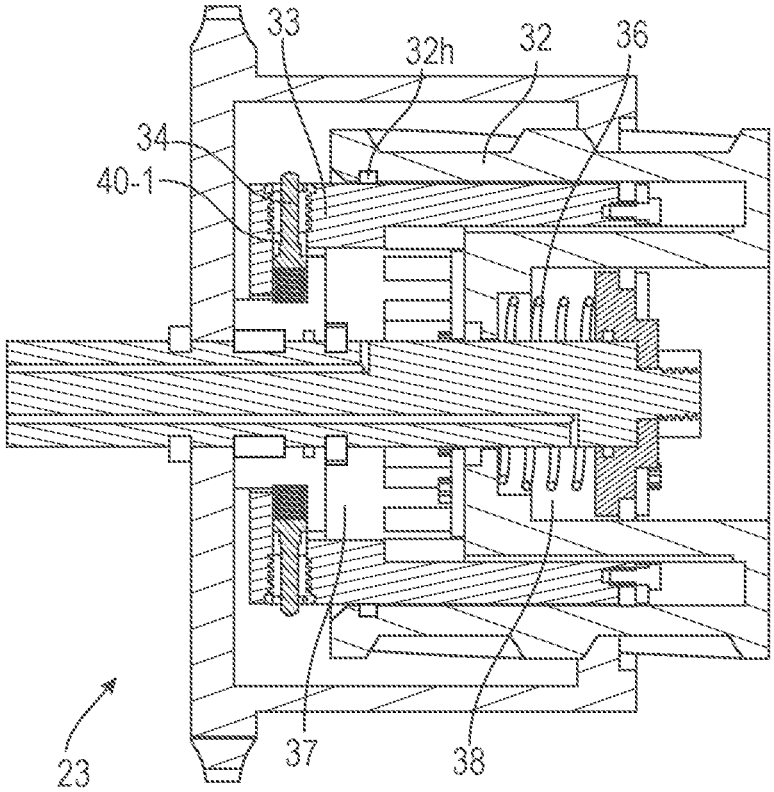
Figure 11C:
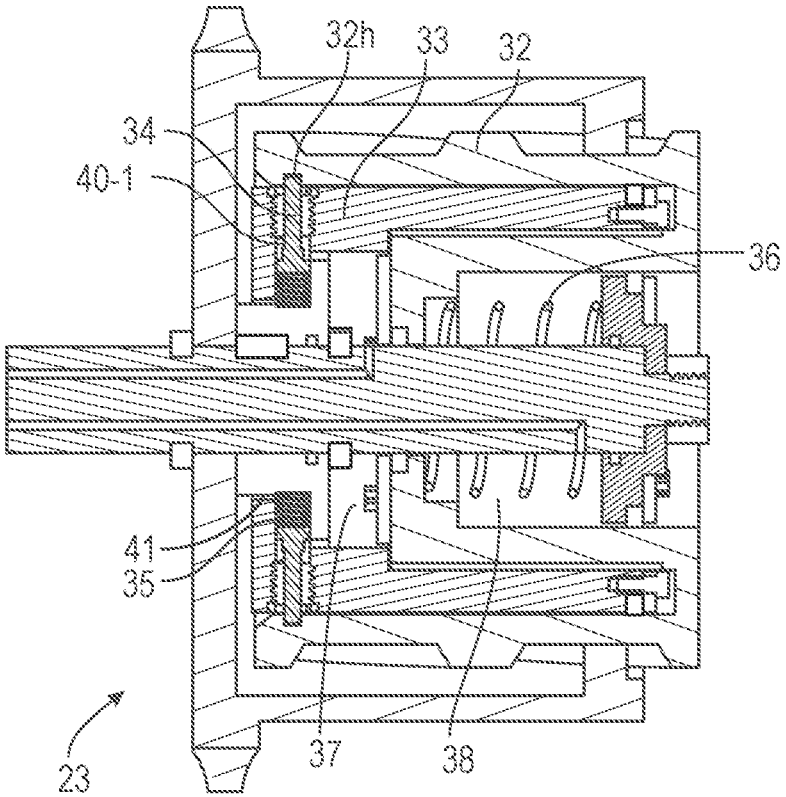

FIGS. 11A-11C, according to exemplary embodiments, depict the VVT assembly 23 in a maximum advance mode, a midway or neutral mode, and a maximum retard mode. Likewise, according to exemplary embodiments, the phaser 32, the phaser inner housing 33, the advancing chamber 37, and the retarding chamber 38 are shown in their respective maximum advance modes, midway or neutral modes, and maximum retard modes. As can be appreciated, the foregoing can operate along a continuum of modes between the maximum advance mode and the maximum retard mode.

In FIG. 11A, in transitioning to the maximum advance mode, according to an exemplary embodiment, fluid from the fluid advancing line 29 can enter the advancing chamber 37, thus increasing the volume size of the advancing chamber 37. Inversely, fluid from the retarding chamber 38 can drain into the retarding fluid line 30, thus reducing the volume size of the retarding chamber 38. Fluid in the advancing chamber 37 can pass through a locking pin fluid channel 40 and into a locking pin fluid chamber 40-1. Fluid in the locking pin fluid chamber 40-1 can exert a downward force on the inner housing locking pin 34 and can overcome a spring force of the locking spring 35. The inner housing locking pin 34 can eventually be disengaged from the phaser slot 32*h*. The locking pin air channel 41 can allow air to exit from the chamber 40-1 where locking spring 35 resides, allowing the locking spring 35 to be compressed and the locking pin 34 to move downward. The increased volume size of the advancing chamber shifts the phaser 32 to the right in the drawing (FIG. 11A). The shift to the right is relative to the phaser inner housing 33 which remains fixed in a linear direction. In the maximum advance mode, a variable volume size of the advancing chamber 37 is at a maximum and a variable volume size of the retarding chamber 38 is at a minimum, in an exemplary embodiment.

In FIG. 11B, in transitioning to the neutral mode, according to an exemplary embodiment, fluid is neither moving filling or draining the advancing chamber 37 and the retarding chamber 38. The phaser 32 is at an intermediate linear position in the drawing (FIG. 11B) relative to the fixed linear position of the phaser inner housing 33. The inner housing locking pin 34 is disengaged from the phaser slot 32*h*. The variable volume size of the advancing chamber 37 is at an intermediate size and the variable volume size of the retarding chamber 38 is at an intermediate size, in an exemplary embodiment.

In FIG. 11C, in transitioning to the maximum retard mode, fluid drains from the locking pin oil chamber 40-1 and into the advance chamber 37. Fluid in the advance chamber 37 drains into the advance fluid line 29. Fluid enters, via the retarding fluid line 30, the retarding chamber 38. The retarding spring 36 has shifted the phaser 32 to the left in the drawing (FIG. 11C) relative to the fixed linear position of the phaser inner housing 33. The locking spring 35 can force the inner housing locking pin 34 upwards, as viewed in the drawing. The locking pin air channel 41 can allow air to enter the chamber 40-1 where the locking spring 35 resides, allowing the locking spring 35 to be decompressed and the locking pin 34 to move upward. The inner housing locking pin 34 becomes engaged in the phaser slot 32*h*. The variable volume size of the advancing chamber 37 is at a minimum and the variable volume size of the retarding chamber 38 is at a maximum, in an exemplary embodiment.

Referring again to FIG. 4, in exemplary embodiments, the fluid pumping assembly 24 can operate in a maximum advance mode, a midway or neutral mode, and a maximum retard mode. As can be appreciated, the fluid pumping assembly 24 can operate along a continuum of modes between the maximum advance mode and the maximum retard mode.

In the fluid pumping assembly 24, the first control valve 25 can operate in a retard mode, according to an exemplary embodiment, and direct fluid from the pump 27 and to the retarding chamber 38, as well as drain oil from the advancing chamber 37 and to the second control valve 26. The first control valve 25 can operate in a neutral mode, according to an exemplary embodiment, and close off fluid flow from the pump 27 to the VVT assembly 23, as well as close off fluid flow from the VVT assembly 23 to the second control valve 26. The first control valve 25 can operate in an advance mode, according to an exemplary embodiment, and direct fluid from the pump 27 and to the advancing chamber 37, as well as drain fluid from the retarding chamber 38 to the second control valve 26.

In the fluid pumping assembly 24, the second control valve 26 can operate in a low flow mode, according to an exemplary embodiment, and use a narrow channel therein to direct fluid drained from the VVT assembly 23 into the fluid reservoir 28. The second control valve 26 can operate in a high flow mode, according to an exemplary embodiment, and use a larger channel therein to direct fluid drained from the VVT assembly 23 into the fluid reservoir 28. The second control valve 26 can operate in a no flow mode, according to an exemplary embodiment, and close off the second control valve 26 to prevent fluid flow therethrough. The second control valve 26 can operate in a combination of low flow mode and high flow mode, according to an exemplary embodiment to affect a rate of shifting of the camshaft 20. The low flow mode can provide a lower rate of cam shifting, while the high flow mode can provide a higher rate of cam shifting.

As can be appreciated, the advancing chamber 37 and the retarding chamber 38 can be configured to respectively cause a rotation of the camshaft 20 in opposite directions. Each chamber 37, 38 can be configured to be operable in a maximum advance mode, a maximum retard mode, and a continuum of modes therebetween. Both chambers 37, 38 can be configured to receive fluid from and discharge fluid to the camshaft 20. Both chambers 37, 38 may be further configured to receive fluid from and discharge fluid to the fluid pumping assembly 24.

Both chamber 37, 38 can be configured with respective variable fluid volumes (i.e., advancing variable fluid volume and retarding variable fluid volume) The respective variable fluid volumes can be configured to vary inversely with one another. Both chambers 37, 38 can also be configured with respective variable fluid volume sizes that are related to a linear position of the phaser 32. Both chambers 37, 38 can further be configured with respective variable fluid volumes that are related to respective linear movement/position of the phaser 32 in opposite linear directions. Further, at least one of the respective variable fluid volume sizes can change the linear position of the phaser 32. Each chamber 37, 38 can be configured to vary in volume size while a linear position of the phaser inner housing 33 is fixed.

Each chamber 37, 38 can be ring-shaped, in an exemplary embodiment. The advancing chamber 37 can be disposed interiorly of the phaser inner housing 33. The retarding chamber 38 can be disposed interiorly of the phaser interior straight spline 32*e*.

Referring again to FIGS. 5 and 6, according to an exemplary embodiment, the VVT assembly 23 may include a sealing assembly to seal fluid, such as engine oil, within the VVT assembly 23.

The sealing assembly may include a camshaft retaining ring 44*a* about the camshaft 20 and in a camshaft slot 20*a*-1, in an exemplary embodiment. The camshaft retaining ring 44*a* can be outside of the main housing 31 and at the main housing sprocket aperture 39*a*. A camshaft retaining ring 44*b*, about the camshaft 20 and in a camshaft slot 20*a*-2, can be within the phaser inner housing 33 and at the inner housing aperture 33*b*, in an exemplary embodiment.

The sealing assembly may further include a camshaft ring seal 45*a*, about the camshaft 20, and between the inner housing pin 33*i* and the camshaft retaining ring 44*b*, according to an exemplary embodiment.

The sealing assembly may further include an inner housing ring seal 46 at the inner housing open end 33*g*, in an exemplary embodiment. Interfacing the ring seal 46 can be at an inner housing securing plate 47*a*, in an exemplary embodiment. Bolt(s) 45 may be used to secure the securing plate 47*a*, and thereby the ring seal 46 to the exterior edge of the inner housing open end 33*g*.

In the sealing assembly, a phaser ring seal 32*i* may be about the camshaft 20 at an exterior surface of the phaser interior partially closed end 321, according to an exemplary embodiment. A phaser securing plate 32*j* can be fixed, via bolt(s) 43, to the phaser interior partially closed end 321 and thereby secure the phaser ring seal 32*i* between the phaser interior partially closed end 321 and the securing plate 32*j*, in an exemplary embodiment. A camshaft ring seal 20*d* may be about the camshaft 20 at an interior surface of the end cap 48.

In the sealing assembly, an end cap 48 may contain an end of the retarding spring 36. An end cap securing plate 48*b* can secure, via end cap bolts 48*c*, an end cap ring seal 48*a* between the securing plate 48*b* and an exterior surface of the end cap 48, in an exemplary embodiment. A camshaft nut 20*c* may be affixed to an end of the camshaft 20 at the exterior surface of the end cap 48.

Embodiments of the present disclosure may be in the form of computer implemented methods and non-transitory computer readable medium with executable instructions stored thereon, executed by a processor, to perform methods. The following are some exemplary embodiments.

For example, a computer implemented method, according to exemplary embodiments, may include controlling, by a controller, a fluid flow into and out of a ring-shaped advancing chamber of a combustion engine; wherein the advancing chamber is configured to cause rotation of a camshaft of the combustion engine in one direction; controlling, by the controller, a fluid flow into and out of a ring-shaped retarding chamber of the combustion engine; wherein the retarding chamber is configured to cause rotation of the camshaft in an opposite direction; and controlling, by the controller, rotation of the camshaft to a maximum advance mode, to a maximum retard mode, and to a continuum of modes therebetween.

For example, a non-transitory computer readable medium, according to exemplary embodiments, may include varying a size of a ring-shaped advancing chamber of a combustion engine; varying a size of a ring-shaped retarding chamber of the combustion engine inversely to the size of the advancing chamber; changing a linear position of a phaser of the combustion engine based on at least one of the size of the advancing chamber and the size of the retarding chamber, wherein the phaser is operatively engaged to a camshaft of the combustion engine; and changing a rotational position of the camshaft based on the linear position of the phaser.

More specific exemplary embodiments of the foregoing computer implemented method and non-transitory computer readable medium follows. As can be appreciated, exemplary embodiments can utilize a computer/electronic control unit to control a variable valve timing assembly by controlling a fluid pumping assembly.

Examples

Figure 12:
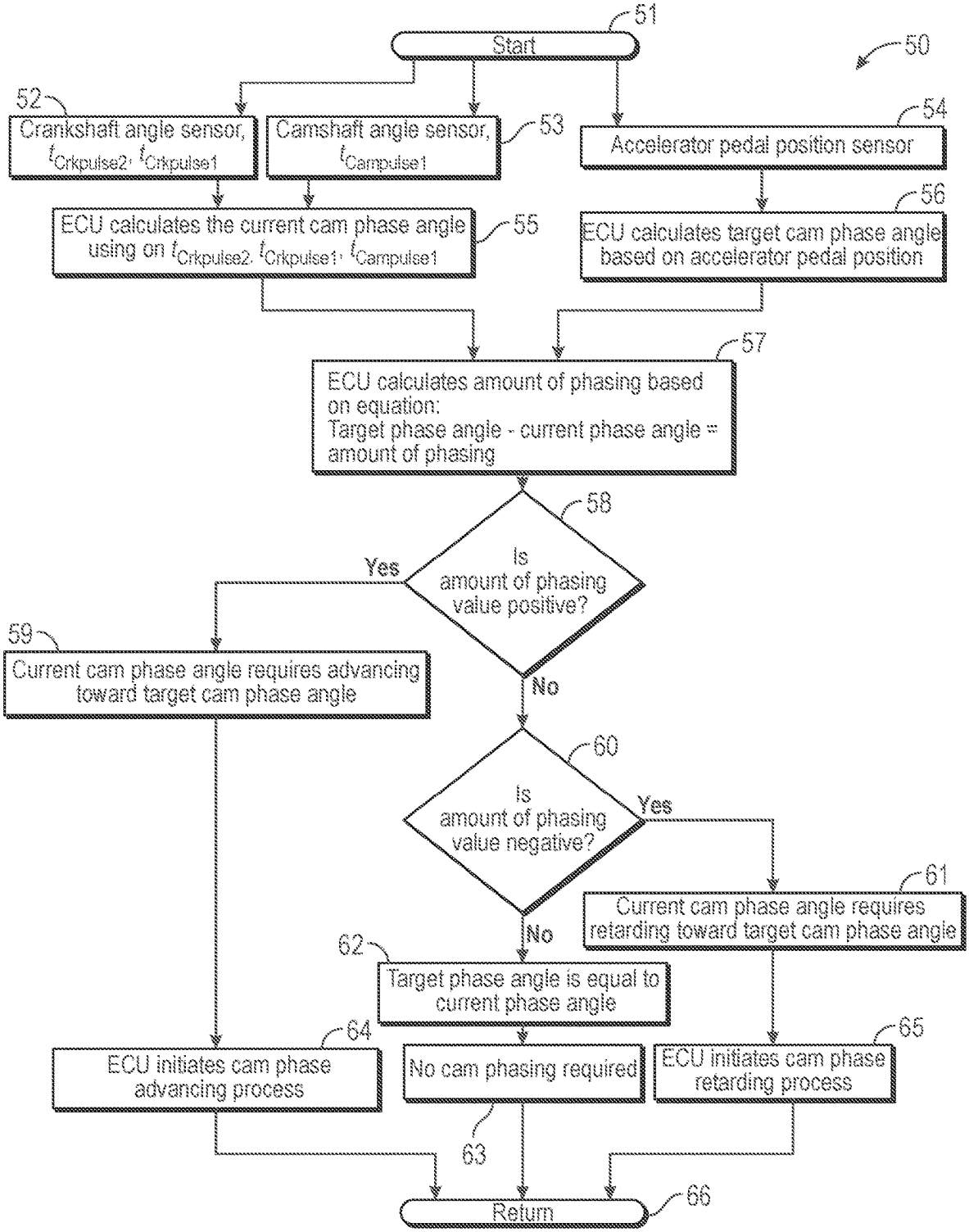
FIG. 12 is a flow chart of an exemplary method of varying an amount and direction of phasing of a camshaft according to the present disclosure.

FIG. 12 is a flow chart of method 50 of VARYING A VALVE TIMING of a combustion engine—in an amount and direction of camshaft phasing—by a computer/electronic control unit (ECU), such as the ECU 13, according to an exemplary embodiment of the present disclosure. The ECU may include a processor and a database.

In an exemplary embodiment, the method 50 may start at a step 51 by initiating the ECU. At a step 52, the ECU can receive signals from a crankshaft angle sensor, such as the crank sensor 22. At a step 53, the ECU can receive signals from a camshaft angle sensor, such as the cam sensor 21. At a step 54, the ECU can receive signals from an accelerator pedal position sensor. At a step 55, the ECU can calculate a current camshaft phase angle. At a step 56, the ECU can calculate a target camshaft phase angle based on an accelerator pedal position.

In an embodiment, current camshaft phase angle can be calculated according to:

$$\left(\frac{360\ Deg}{tCrkpulse2 - tCrkpulse1}\right) \times \frac{1}{2}(tCrkpulse2 - tCampulse1)$$

wherein:

tCrkpulse1—the first pulse received by ECU from crankshaft angle sensor tCrkpulse2—the second pulse received by ECU from the crankshaft angle sensor tCampulse1—the pulse received by ECU from camshaft angle sensor In an embodiment, target camshaft phase angle can be calculated according to:

If accelerator pedal sensor>50%, then:

$$2(Ap-50\%)\times(\text{Max advance deg})=\text{Intake target advance cam phase angle}$$

$$-2(Ap-50\%)\times(\text{Max retard deg})=\text{Exhaust target retard cam phase angle}$$

If accelerator pedal sensor<50%, then:

$$-2(50\%-Ap)\times(\text{Max retard deg})=\text{Intake target retard cam phase angle}$$

wherein:

Ap—Accelerator pedal position sensor reading of driver foot pressure in percentage Max advance deg—The maximum degree that the oil vane apparatus can advance (physical limit set by manufacturer)

Max retard deg—The maximum degree that the oil vane apparatus can retard (physical limit set by manufacturer)

The method 50, according to an exemplary embodiment, can include a step 57 wherein the ECU can calculate an amount of target phasing that is equal to the target phase angle minus the current phase angle. At a step 58, the ECU can determine whether the amount of target phasing is positive. If "yes" at step 58, at a step 59, the ECU can determine the required cam phase angle advance to reach the target camshaft phase angle. At a step 64, the ECU can initiate a cam phase advancing process. At a step 66, the method 50 can return to the step 51 to restart.

In an embodiment, an amount of target phasing can be calculated according to:

$$\text{Target phase angle}-\text{current phase angle}=\text{amount of phasing}$$

wherein:

Direction of phasing is based on the amount of phasing calculation value:

if the value is greater than zero then it is advance phasing if the value is zero then it is neutral phasing. No phasing needed.

if the value is less than zero then it is retard phasing.

If "no" at step 58, at a step 60, the ECU can determine whether the amount of target phasing is negative. If "yes" at step 60, at a step 61, the ECU can determine the required cam phase angle retard to reach the target camshaft phase angle. At a step 65, the ECU can initiate a cam phase retarding process. At the step 66, the method 50 can return to the step 51 to restart.

If "no" at step 60, the ECU can determine that the target phase angle is the equal to the current phase angle. At a step 63, the ECU can determine that no camshaft phasing is required. At the step 66, the method 50 can return to the step 51 to restart.

Figure 13:
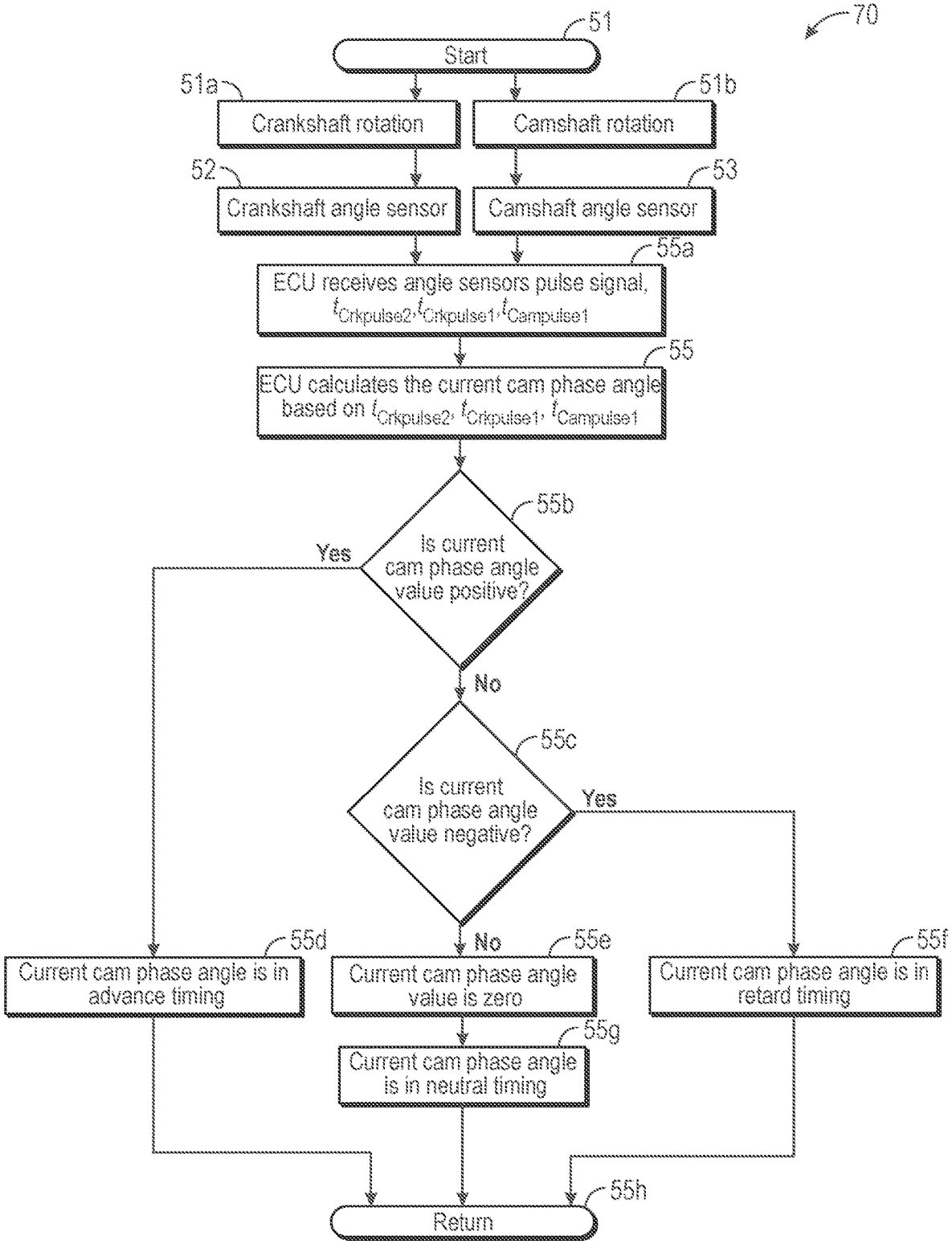
FIG. 13 is a flow chart of an exemplary method of determining a current camshaft phase angle according to the present disclosure.

FIG. 13 is a flow chart of a method 70 of determining a CURRENT CAMSHAFT PHASE ANGLE, according to an exemplary embodiment of the present disclosure. The method 70 may start at the step 51 (FIG. 12) by initiating a computer/electronic control unit (ECU), such as the ECU 13. At a step 51*a*, the ECU may detect the presence of crankshaft rotation. At a step 52 (FIG. 12), the ECU may receive signals from a crankshaft angle sensor, such as the crank sensor 22. At a step 51*b*, the ECU may detect the presence of camshaft rotation. At a step 53 (FIG. 12), the ECU may receive signals from a camshaft angle sensor, such as the cam sensor 21.

At a step 55*a*, the ECU can receive signals from the crankshaft angle sensor and from the camshaft angle sensor. At a step 55, the ECU can calculate a current camshaft phase angle. At a step 55*b*, the ECU can determine if the current camshaft phase angle is positive. If "yes" at step 55*b*, at a step 55*d*, the ECU can determine that the current camshaft phase angle is in advance timing. At a step 55*h*, the method 70 can restart at the step 51.

If "no" at the step 55*b*, at a step 55*c*, the ECU can determine if the current camshaft phase angle is negative. If "yes" at the step 55*c*, at a step 55*f*, the ECU can determine that the current camshaft phase angle is in retard timing. At the step 55*h*, the method 70 can restart at the step 51.

If "no" at the step 55*c*, at a step 55*e*, the ECU 13 can determine that the current camshaft phase angle is zero. At a step 55*g*, the ECU 13 can determine that the current camshaft phase angle is in neutral timing. At the step 55*h*, the method 70 can restart at the step 51.

Figure 14:
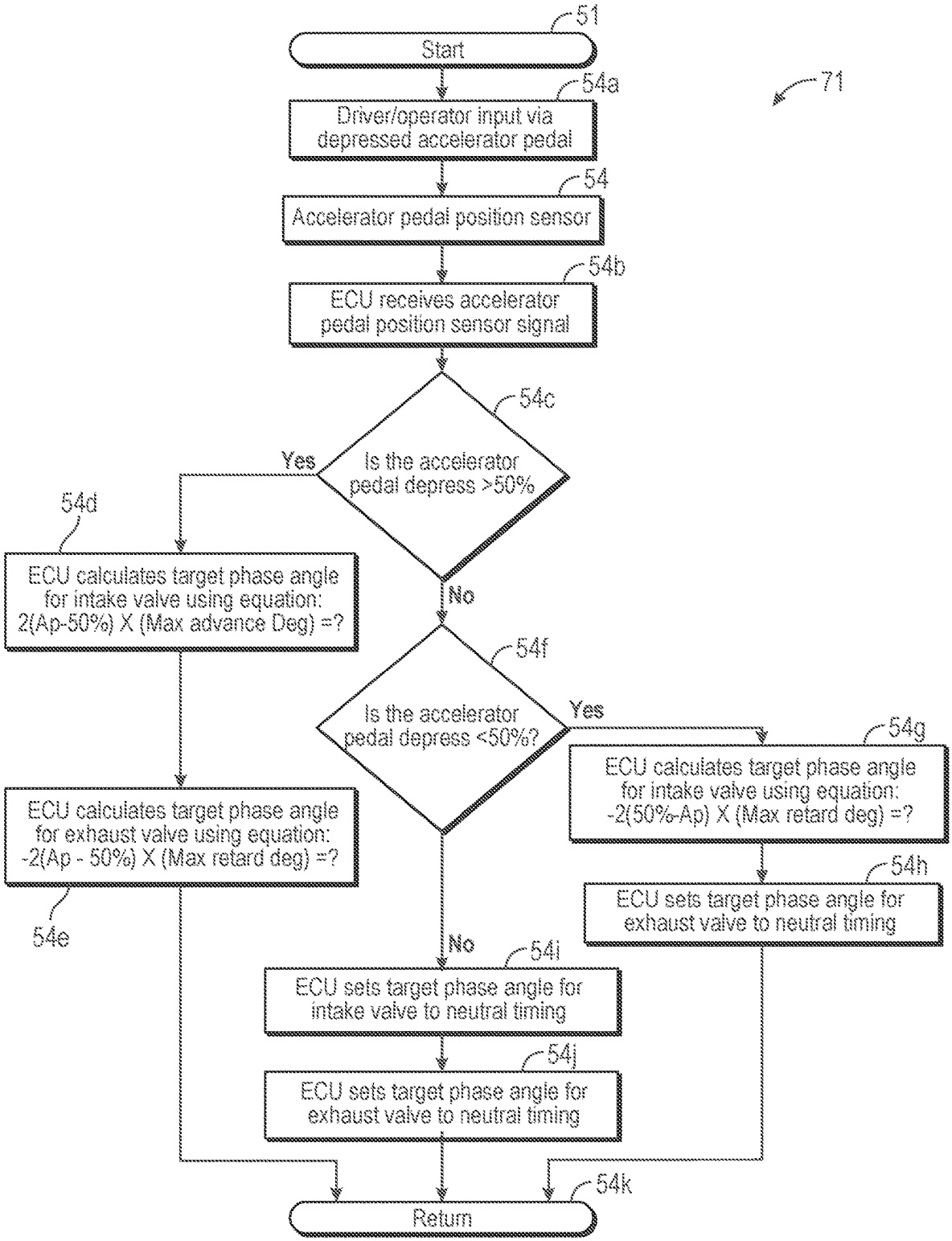
FIG. 14 is a flow chart of an exemplary method of determining a target camshaft phase angle according to the present disclosure.

FIG. 14 is a flow chart of a method 71 of determining a TARGET CAMSHAFT PHASE ANGLE, according to an exemplary embodiment of the present disclosure. The method 71 may start at the step 51 (FIG. 12) by initiating a computer/electronic control unit (ECU), such as the ECU 13. At a step 54*a*, the ECU may detect the depressing of an accelerator pedal. At a step 54, the ECU may detect an accelerator pedal position sensor. At a step 54*b*, the ECU may receive signals from the accelerator pedal position sensor.

At a step 54*c*, the ECU can determine if the accelerator pedal has been depressed by more than a predetermined amount, such as by more than 50%. If "yes" at step 54*c*, at a step 54*d*, the ECU can calculate a target phase angle for the intake valve. At a step 54*e*, the ECU can calculate a target phase angle for the exhaust valve. At a step 54*k*, the method 71 can restart at the step 51.

If "no" at the step 54*c*, at a step 54*f*, the ECU can determine if the accelerator pedal has been depressed by less than the predetermined amount, such as by less than 50%. If "yes" at step 54*f*, at a step 54*g*, the ECU can calculate a target phase angle for the intake valve. At a step 54*h*, the ECU can set a target phase angle for the exhaust valve for neutral timing. At a step 54*k*, the method 71 can restart at the step 51.

If "no" at the step 54*f*, at a step 54*i*, the ECU can set a target phase angle for the intake valve at neutral timing. At a step 54*j*, the ECU can set a target phase angle for the exhaust valve to neutral timing. At the step 54*k*, the method 71 can restart at the step 51.

Figure 15:
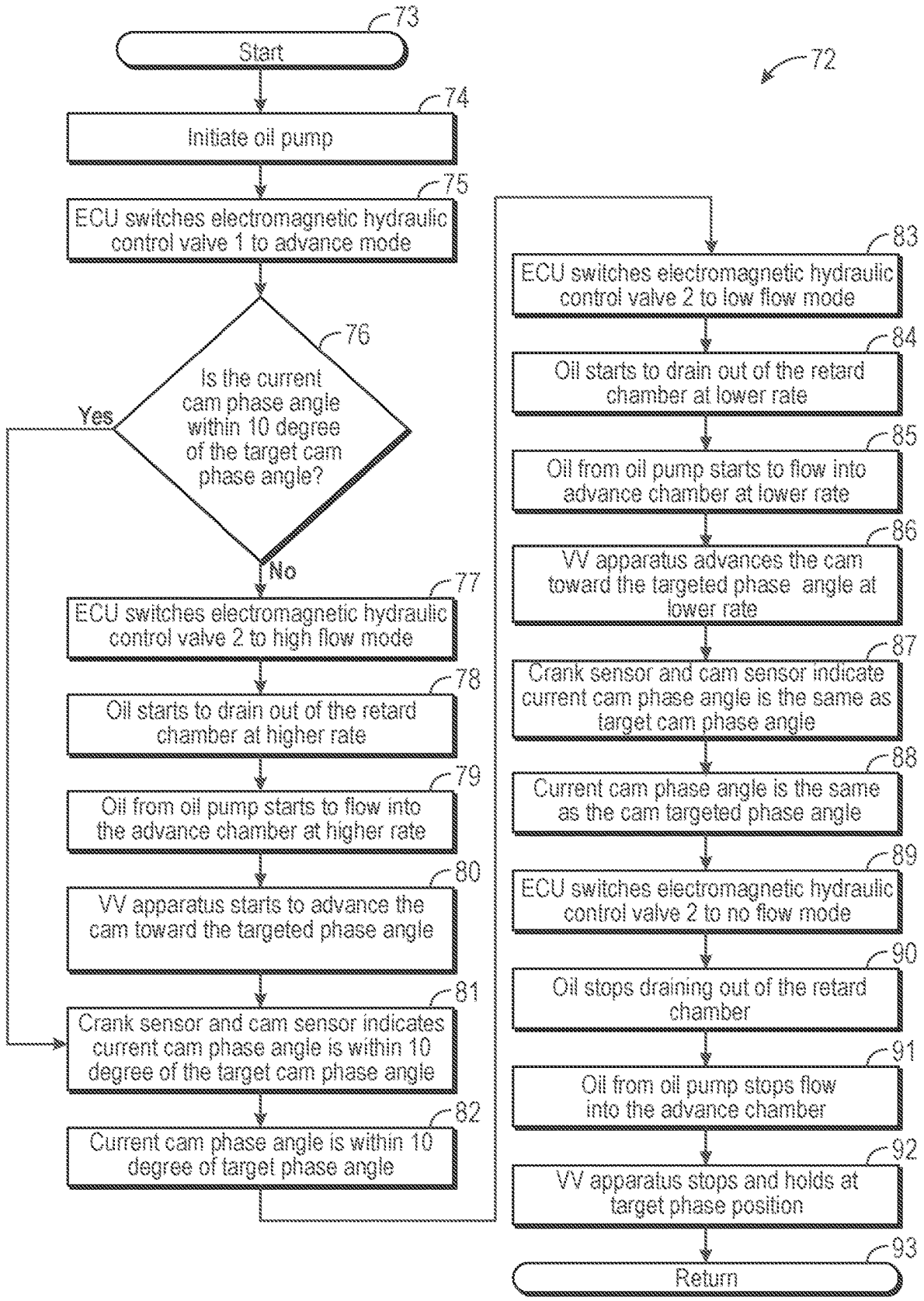
FIG. 15 is a flow chart of an exemplary method of advancing a phasing of a camshaft according to the present disclosure.

FIG. 15 is a flow chart of a method 72 of a process of ADVANCE PHASING of a camshaft, such as the camshaft 20. The method 72 may start at a step 73 by a computer/electronic control unit (ECU), such as the ECU 13, communicating with an oil pump, such as the pump 27. At a step 74, the ECU may initiate the oil pump. At a step 75, the ECU may switch a control valve 1, such as the first control valve 25, to an advance mode. At a step 76, the ECU may determine if a current cam phase angle is within a predetermined range, such as 10 degrees, of a target cam phase angle.

If "no" at the step 76, at a step 77, the ECU may switch a control valve 2, such as the second control valve 26, to a high flow mode. At a step 78, the ECU may enable oil to drain out of a retarding chamber, such as the retarding chamber 38, at a high rate. At a step 79, the ECU may enable oil from the oil pump to flow into an advancing chamber, such as the advancing chamber 37, at a high rate. At a step 80, a variable valve (VV) apparatus, such as the VVT assembly 23, may start to advance the cam toward a targeted phase angle. At a step 81, the ECU may determine if signals from a crank sensor (such as the crank sensor 22) and a cam sensor (such as the cam sensor 21) are within a predetermined range of a target cam phase angle, such as 10 degrees.

At a step 82, the ECU can determine that the current cam phase angle is within the predetermined range of the target phase angle. At a step 83, the ECU can switch the control valve 2 to a low flow mode. At a step 84, the ECU can enable oil to drain out of the retarding chamber at a low rate. At a step 85, the ECU may enable oil from the oil pump to flow into the advancing chamber at a low rate.

At a step 86, the VV apparatus can advance the cam toward the targeted phase angle at a low rate. At a step 87, the ECU can determine if signals from the crank sensor and the cam sensor indicate that the current cam phase angle is the same as the target cam phase angle. At a step 88, the ECU can determine that the current cam phase angle is the same as the targeted cam phase angle.

At a step 89, the ECU may switch the control valve 2 to a no flow mode. At a step 90, oil stops draining out of the retarding chamber. At a step 91, the ECU stops the oil pump from flowing oil into the advancing chamber. At a step 92, the ECU can cause the VV apparatus to stop and hold at the targeted phase position. At a step 93, the method 72 can return to step 73.

Returning back, if "yes" at step 76, the method moves to step 81 and continues through step 93.

Figure 16:
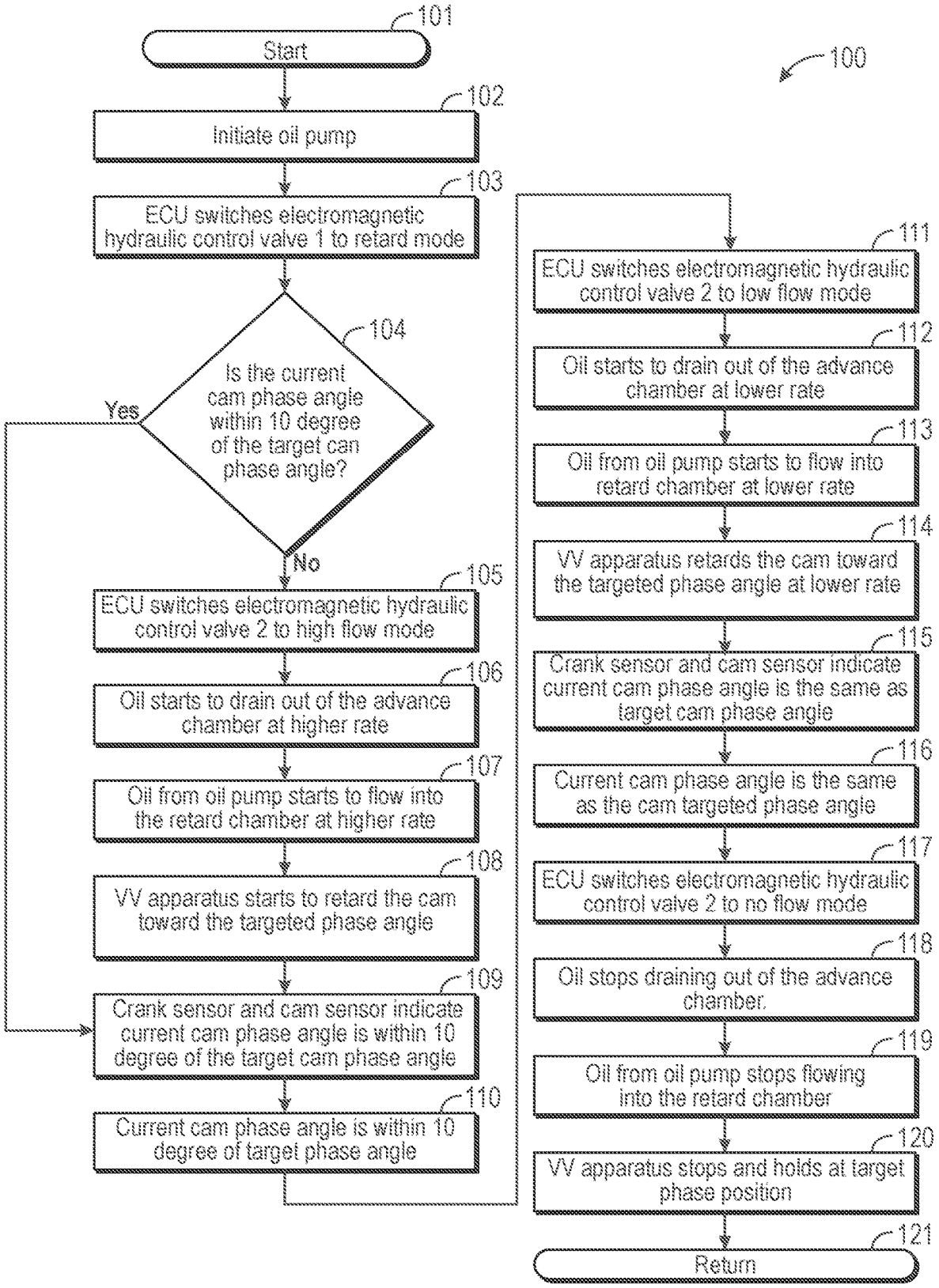
FIG. 16 is a flow chart of an exemplary method of retarding a phasing of a camshaft according to the present disclosure.

FIG. 16 is a flow chart of a method 100 of a process of RETARD PHASING of a camshaft, such as the camshaft 20. The method 100 may start at a step 101 by a computer/electronic control unit (ECU), such as the ECU 13, communicating with an oil pump, such as the pump 27. At a step 102, the ECU may initiate the oil pump. At a step 103, the ECU may switch a control valve 1, such as the first control valve 25, to a retard mode. At a step 104, the ECU may determine if a current cam phase angle is within a predetermined range, such as 10 degrees, of a target cam phase angle.

If "no" at the step 104, at a step 105, the ECU may switch a control valve 2, such as the second control valve 26, to a high flow mode. At a step 106, the ECU may enable oil to drain out of an advancing chamber, such as the advancing chamber 37, at a high rate. At a step 107, the ECU may enable oil from the oil pump to flow into a retarding chamber, such as the retarding chamber 38, at a high rate. At a step 108, a variable valve (VV) apparatus, such as the VVT assembly 23, may start to retard the cam toward a targeted phase angle. At a step 109, the ECU may determine if signals from a crank sensor (such as the crank sensor 22) and a cam sensor (such as the cam sensor 21) are within a predetermined range of a target cam phase angle, such as 10 degrees.

At a step 110, the ECU can determine that the current cam phase angle is within the predetermined range of the target phase angle. At a step 111, the ECU can switch the control valve 2 to a low flow mode. At a step 112, the ECU can enable oil to drain out of the advancing chamber at a low rate. At a step 113, the ECU may enable oil from the oil pump to flow into the retarding chamber at a low rate.

At a step 114, the VV apparatus can retard the cam toward the targeted phase angle at a low rate. At a step 115, the ECU can determine if signals from the crank sensor and the cam sensor indicate that the current cam phase angle is the same as the target cam phase angle. At a step 116, the ECU can determine that the current cam phase angle is the same as the targeted cam phase angle.

At a step 117, the ECU may switch the control valve 2 to a no flow mode. At a step 118, oil stops draining out of the advancing chamber. At a step 119, the ECU stops the oil pump from flowing oil into the retarding chamber. At a step 120, the ECU can cause the VV apparatus to stop and hold at the targeted phase position. At a step 121, the method 100 can return to step 101.

Returning back, if "yes" at step 104, the method moves to step 109 and continues through step 121.

Figure 17:
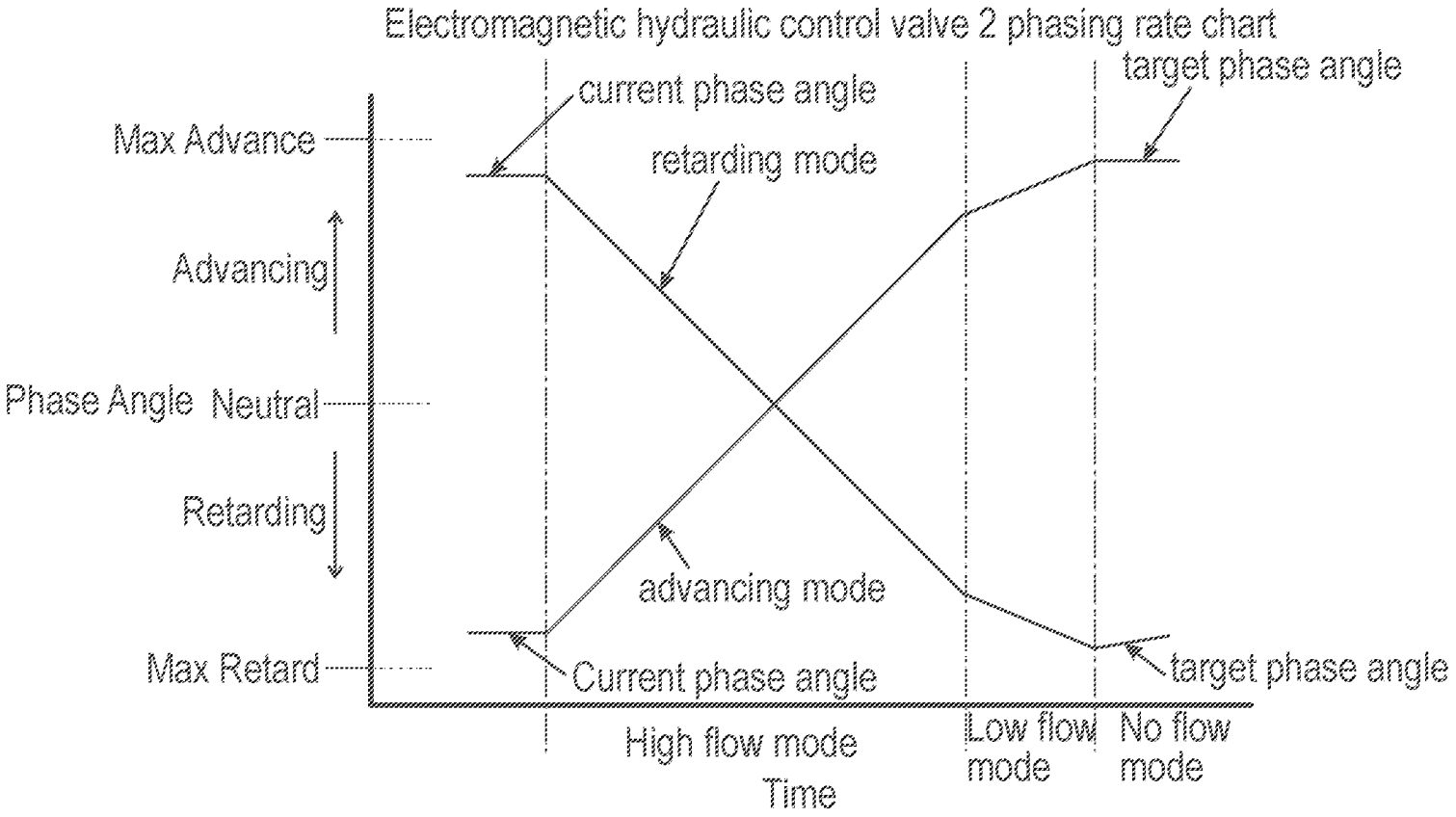
FIG. 17 is a graph of an exemplary method of camshaft phase angle versus flow mode/time according to the present disclosure.

FIG. 17 is a graph of cam phase angle versus time (control valve 2 mode of flow), for advance phasing and retard phasing, according to embodiments of the present disclosure. Control valve 2 refers to the control valve described in FIGS. 15 and 16. The graph depicts a transition from or near maximum advance to near or at maximum retard, and vice versa.

Figure 18:
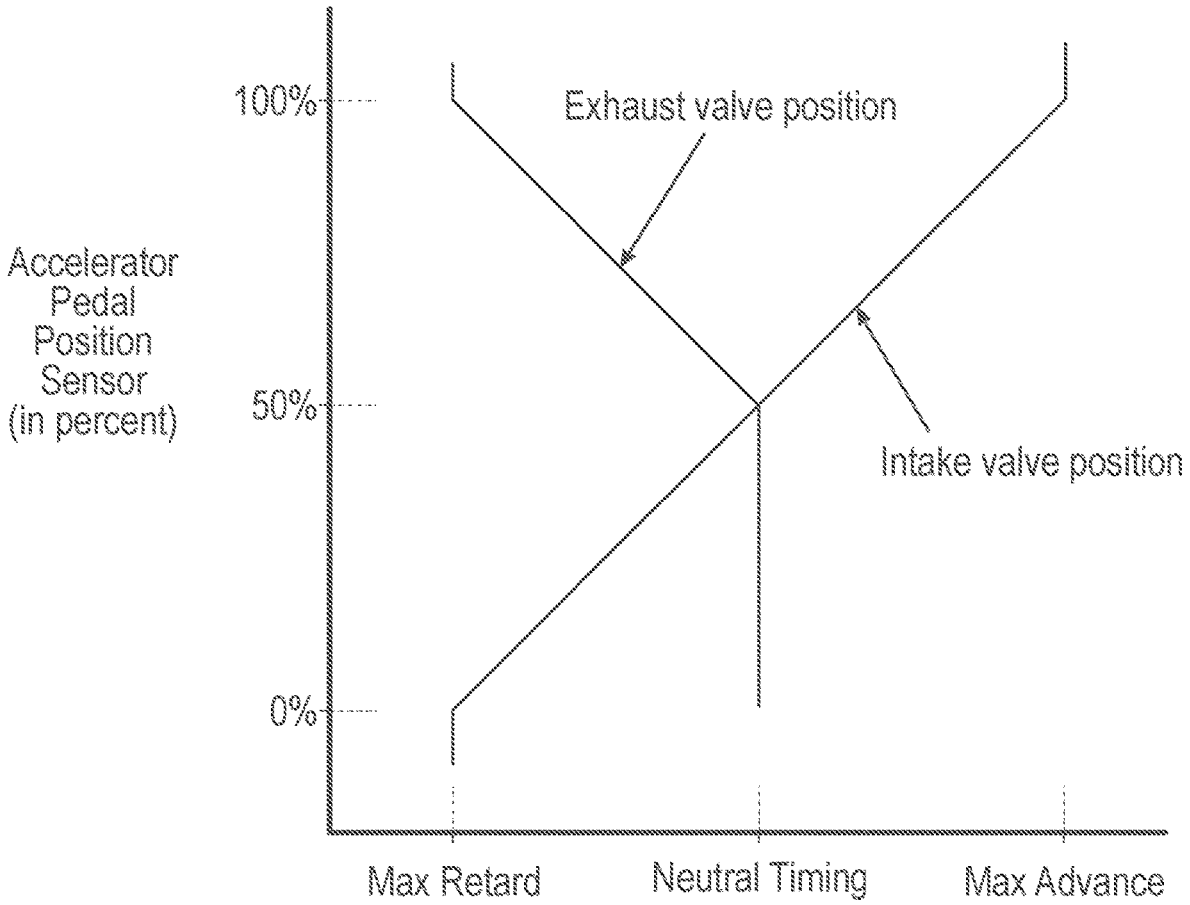
FIG. 18 is a graph of an exemplary method of accelerator pedal position versus camshaft phasing according to the present disclosure.

FIG. 18 is a graph of accelerator pedal position versus intake/exhaust valve position, according to embodiments of the present disclosure. For the intake valve position, as the accelerator pedal is further depressed, the present disclosure varies the camshaft position (i.e., valve position) from at or near maximum retard towards maximum advance, and somewhat vice versa for the exhaust valve position.

It should be understood, of course, that the foregoing relates to exemplary embodiments of the disclosure and that modifications may be made without departing from the scope of the disclosure as set forth in the following claims.

I claim:

1. A variable valve timing (VVT) assembly for a combustion engine, the VVT assembly comprising:

a phaser configured to receive a camshaft of the combustion engine, the phaser including:

a cylindrical phaser exterior body, a cylindrical phaser interior body arranged within the phaser exterior body, a phaser exterior spline formed on an outer surface of the phaser exterior body, and a phaser interior spline formed on an outer surface of the phaser interior body;

a phaser inner housing disposed within the phaser so as to receive the camshaft, the phaser inner housing including an inner housing interior spline that mates with the phaser interior spline;

an advancing chamber configured to receive fluid from and discharge fluid to the camshaft;

a retarding chamber configured to receive fluid from and discharge fluid to the camshaft; and a main housing enclosing the phaser and the phaser inner housing, the main housing configured to engage a timing chain/belt of the combustion engine.

2. The VVT assembly of claim 1, wherein:

the phaser inner housing is cylindrical; and the main housing is cylindrical.

3. The VVT assembly of claim 1, wherein:

the advancing chamber is ring-shaped; and the retarding chamber is ring-shaped.

4. The VVT assembly of claim 1, wherein:

the advancing chamber includes a first variable fluid volume;

the retarding chamber includes a second variable fluid volume; and the first variable fluid volume varies inversely with the second variable fluid volume.

5. The VVT assembly of claim 1, wherein:

the advancing chamber and the retarding chamber are collectively operable in a continuum of modes between a maximum advance mode and a maximum retard mode, inclusively.

6. The VVT assembly of claim 1, wherein:

an axial position of the phaser relative to the phaser inner housing is variable.

7. A variable valve timing (VVT) assembly for a combustion engine, the VVT assembly comprising:

a phaser configured to be actuated via a retarding spring, the phaser including:

a phaser exterior body, a phaser interior body arranged within the phaser exterior body, a circumferential phaser gap between the phaser exterior body and the phaser interior body, a phaser exterior spline, and a phaser interior spline;

a cylindrical phaser inner housing disposed in the phaser gap so as to receive a camshaft of the combustion engine, the phaser inner housing including:

a cylindrical inner housing body, and an inner housing interior spline formed on an inner surface of the inner housing body so as to mate with the phaser interior spline;

an advancing chamber including a first variable volume related to a linear position of the phaser;

a retarding chamber including a second variable volume related to the linear position of the phaser; and a main housing that mates with the phaser.

8. The VVT assembly of claim 7, wherein:

the retarding spring is disposed within the phaser interior body; and the retarding spring actuates the phaser in a linear direction.

9. The VVT assembly of claim 7, wherein:

a rotation of the phaser relative to the main housing moves the phaser in a linear direction.

10. The VVT assembly of claim 7, wherein:

the phaser inner housing is rotationally coupled to the camshaft.

11. The VVT assembly of claim 7, wherein:

the phaser interior spline is straight;

the phaser exterior spline is helical; and the inner housing interior spline is straight.

12. The VVT assembly of claim 7, wherein:

the main housing includes main housing teeth that mate with the phaser exterior spline.

13. The VVT assembly of claim 7, wherein:

the main housing includes a sprocket configured to engage a timing chain/belt of the combustion engine.

14. A variable valve timing (VVT) assembly for a combustion engine, the VVT assembly comprising:

a phaser including:

a phaser exterior body, a phaser exterior helical spline formed on an outer surface of the phaser exterior body, a phaser interior body arranged within the phaser exterior body, and a phaser interior straight spline formed on an outer surface of the phaser interior body;

a phaser inner housing disposed within the phaser, the phaser inner housing including an inner housing interior straight spline that mates with the phaser interior straight spline;

a ring-shaped advancing chamber defined within the phaser inner housing, the advancing chamber configured to be in fluid communication with a fluid pumping assembly;

a ring-shaped retarding chamber defined within the phaser interior body, the retarding chamber configured to be in fluid communication with the advancing chamber; and a main housing including interior helical teeth that mate with the phaser exterior helical spline, the main housing configured to receive and engage a camshaft of the combustion engine;

wherein the advancing chamber includes an advancing variable fluid volume;

wherein the phaser moves in a first linear direction when the advancing variable fluid volume is increased;

wherein the retarding chamber includes a retarding variable fluid volume; and wherein the phaser moves in a second linear direction when the retarding variable fluid volume is increased.

15. The VVT assembly of claim 14, wherein:

the retarding chamber is further configured to be in fluid communication with the fluid pumping assembly.

16. The VVT assembly of claim 14, wherein:

the advancing variable fluid volume varies inversely with the retarding variable fluid volume.

17. The VVT assembly of claim 14, wherein:

the phaser inner housing remains in a fixed linear position as the phaser moves in the first and second linear directions;

the camshaft rotates in a first rotational direction relative to the main housing when the phaser moves in the first linear direction; and the camshaft rotates in a second rotational direction relative to the main housing when the phaser moves in the second linear direction.

18. The VVT assembly of claim 14, wherein:

the phaser is configured to be operable in a continuum of modes between a maximum advance mode and a maximum retard mode, inclusively.

19. The VVT assembly of claim 14, wherein:

the advancing chamber and the retarding chamber are collectively operable in a continuum of modes between a maximum advance mode and a maximum retard mode, inclusively.

20. The VVT assembly of claim 14, wherein:

the phaser further includes a phaser slot;

the phaser inner housing further includes an inner housing locking pin; and the inner housing locking pin engages the phaser slot so as to lock a position of the phaser relative to the phaser inner housing when the phaser is in a maximum retard mode.

* * * * *